US006418292B1

(12) United States Patent
Isobe et al.

(10) Patent No.: US 6,418,292 B1
(45) Date of Patent: Jul. 9, 2002

(54) DEVELOPER REPLENISHING CONTAINER WITH MOVABLE SHUTTER FEATURE, CARTRIDGE AND IMAGE FORMING APPARATUS EMPLOYING DEVELOPER REPLENISHING CONTAINER

(75) Inventors: Hironobu Isobe; Kenji Matsuda; Akiyoshi Fujita, all of Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/536,305

(22) Filed: Mar. 27, 2000

(30) Foreign Application Priority Data

Mar. 29, 1999 (JP) ..... 11-087071
Mar. 29, 1999 (JP) ..... 11-087073

(51) Int. Cl.[7] ..... G03G 15/08
(52) U.S. Cl. ..... 399/258; 399/262
(58) Field of Search ..... 399/258, 260, 399/262

(56) References Cited

U.S. PATENT DOCUMENTS 5,520,229 A * 5/1996 Yamada ..... 399/262 X
6,064,844 A 5/2000 Isobe et al. ..... 399/119
6,185,401 B1 * 2/2001 Kanamori et al. ..... 399/262

FOREIGN PATENT DOCUMENTS

JP 10-207204 8/1998

* cited by examiner

*Primary Examiner*—William J. Royer
(74) *Attorney, Agent, or Firm*—Fitzpatrick, Cella, Harper & Scinto

(57) ABSTRACT

The present invention relates to a developer replenishing container detachably attachable to a main body of an image forming apparatus which has a container body including an developer containing portion for containing a developer, a replenishing opening portion for replenishing the developer contained in the developer containing portion to a cartridge including a developing device detachably attachable to the main body of the image forming apparatus, a shutter member movable between an opened position and a closed position for opening and closing the replenishing opening portion, and a force receiving portion for receiving force, which moves the shutter member from the closed position to the opened position, from the cartridge.

23 Claims, 29 Drawing Sheets

DEVELOPER REPLENISHING CONTAINER WITH MOVABLE SHUTTER FEATURE, CARTRIDGE AND IMAGE FORMING APPARATUS EMPLOYING DEVELOPER REPLENISHING CONTAINER

BACKGROUND OF THE INVENTION

1. Field of the Invention

The present invention relates to a developer replenishing container detachably attachable to an image forming apparatus body (a main body of an image forming apparatus), a cartridge detachably attachable to the apparatus body and an image forming apparatus having the developer replenishing container and the cartridge.

The image forming apparatus forms an image on a recording medium using an image forming process. The image forming apparatus includes an electrophotographic copier, an electrophotographic printer (LED printer, laser beam printer or the like), an electrophotographic facsimile device, an electrophotographic word processor and the like.

Further, an example of the cartridges is a process cartridge. In the process cartridge, at least one of a charging means, a developing means and a cleaning means and an electrophotographic photosensitive member as an image bearing member are integrated into a cartridge and this cartridge is formed to be detachably attachable to an image forming apparatus body.

Further, another example of the cartridges is a developing cartridge. In the developing cartridge, a developer containing portion and a developer bearing member are integrated into a cartridge and this cartridge is formed to be detachably attachable to an image forming apparatus body.

2. Related Background Art

In an electrophotographic image forming apparatus using an electrophotographic image forming process, a process cartridge system has been adopted in which an electrophotographic photosensitive drum as an image bearing member and a process means that acts on the electrophotographic photosensitive drum are integrally formed as a cartridge and the cartridge can be detachably attachable to an electrophotographic image forming apparatus body. According to the process cartridge system, maintenance of the apparatus can be performed by not a serviceman but a user himself and the operability can be significantly improved. Thus, the process cartridge system has been widely used in electrophotographic image forming apparatuses.

Further, a cartridge configuration in which process means are divided into groups having long life and short life, each process means is made into a cartridge, and the groups can be used in accordance with the life of the main process means has also been realized. For example, a developing cartridge in which a toner containing portion and a developing means are integrally formed, a process cartridge in which an electrophotographic photosensitive member, a charging means and a cleaning means are integrally formed, or the like has been adopted.

A demand for a color electrophotographic image forming apparatus capable of forming a color image is recently increased. Thus, an introduction of a color electrophotographic image forming apparatus which can attain the following six items is expected:

(1) Low running cost (2) Small space (3) Low power (4) Image having high quality (5) High speed (6) Improvement of operability In these demands, for example, as a process corresponding to the item (1) low running cost, a further increase in the life of the above-mentioned process means can be considered.

However, an amount of toner corresponding to the life of process means becomes an amount proportional to the life. For example, in a case where the life of process means is 50000 sheets of images, an amount of toner needed reaches 1.25 to 1.5 kg. When such a large amount of toner is integrally contained in a cartridge, the total weight and volume of cartridge significantly become large and an operability may be lowered.

Further, since a space occupied by the entire cartridge is increased, miniaturization (downsizing) of the entire apparatus may become difficult. Further, a frame formation for supporting a cartridge with a large weight with high precision is needed and the cost may increase totally.

Further, in the case where a developer is replenished from a developer replenishing container to a cartridge, the improvement of operability and the prevention of dispersion of the developer are desired.

SUMMARY OF THE INVENTION

An object of the present invention is to provide a developer replenishing container, a cartridge and an image forming apparatus which may miniaturize the cartridge and reduce the cost thereof by replenishing a developer from the developer replenishing container to the cartridge.

Another object of the present invention is to provide a developer replenishing container, a cartridge and an image forming apparatus with which operability is improved and dispersion of the developer is prevented by controlling replenishment so that a developer is not replenished from a developer replenishing container by an error in the case of no cartridge.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Embodiments of the present invention will be described with reference to drawings.

In the following descriptions, a longitudinal direction of a process cartridge is defined as a direction in which a process cartridge is mounted within an electrophotographic image forming apparatus body, and is a direction which intersects (substantially at a right angle) to a transfer direction of a recording medium. The longitudinal direction of the process cartridge is the same as the axial direction of an electrophotographic photosensitive member. Further, the left and right in this descriptions are defined as the left and right in the transfer direction of the recording medium. Further, the upper and lower are defined as the upper and lower in a cartridge-mounted state.

[Embodiment 1]

(Explanation of the Entire Electrophotographic Image Forming Apparatus)

First, the entire configuration of a color electrophotographic image forming apparatus according to the present embodiment will be schematically described with reference to FIG. 1.

Figure 1:
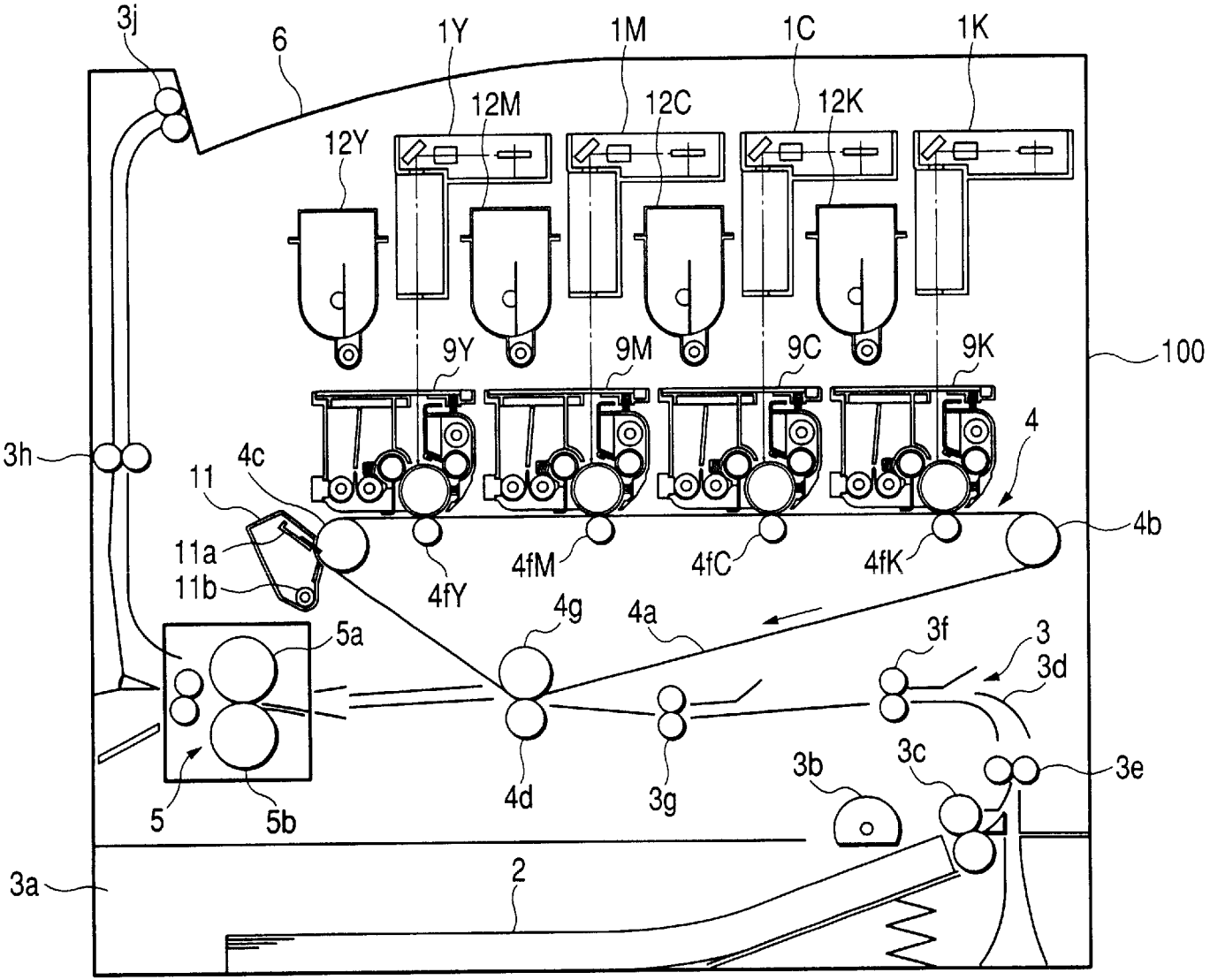
FIG. 1 is a cross-sectional view of an electrophotographic image forming apparatus of Embodiment 1.

FIG. 1 is an explanatory view showing the entire configuration of a color laser beam printer which is an embodiment of a color toner electrophotographic image forming apparatus.

An image forming portion of an electrophotographic image forming apparatus (a color laser beam printer) shown in this embodiment is formed in such a manner that four process cartridges 9Y, 9M, 9C, 9K (yellow, magenta, cyan, black) each having a drum-shaped electrophotographic photosensitive member 7 (referred to as "photosensitive drum" below) and exposure means 1Y, 1M, 1C, 1K (laser beam optical scanning systems) corresponding to the respective colors, positioned above the process cartridges 9Y, 9M, 9C, 9K are placed in parallel respectively.

Below the above-mentioned image forming portion, a feeding means 3 for feeding a recording medium (material) 2, an intermediate transfer belt 4*a* for transferring a toner image formed on the photosensitive drum 7, and a secondary transfer roller 4*d* for transferring a toner image on the intermediate transfer belt 4*a* to the recording medium 2 are placed.

Also, a fixing means 5 for fixing the recording medium 2 onto which a toner image was transferred, and discharging means 3*h*, 3*j* for discharging and stacking the recording medium 2 to and from the exterior of the apparatus, are placed.

The recording medium 2 includes, for example, a paper, an OHP sheet, a cloth or the like.

The image forming apparatus of the present embodiment is a cleanerless system. Thus, toner remaining on the photosensitive drum 7 after transfer is carried in a developing means 10 later described and a cleaner specifically used for collecting and reserving toner remaining after transfer is not provided in the process cartridges 9Y, 9M, 9C, 9K.

Configurations of the respective portions of the above-mentioned image forming apparatus will be, in turn, described.

(Feeding Portion)

The feeding portion (feeding means) 3 feeds the recording medium 2 to the image forming portion and mainly includes a feed cassette 3*a* holding and stacking plural sheets of recording medium 2, a feed roller 3*b*, a double-feed preventing retard roller 3*c*, a feed guide 3*d*, and a registration roller 3*g*.

The feed roller 3*b* is driven to rotate in accordance with an image forming operation and separates and feeds the recording medium 2 in the feed cassette 3*a* one by one. The recording medium 2 is guided with the feed guide 3*d* and is conveyed to the registration roller 3*g* through feed rollers 3*e*, 3*f*.

Just after the recording medium 2 was conveyed, the registration roller 3*g* is stopped to rotate. A skew feed of the recording medium 2 is corrected by lumping (hitting) the leading end of the recording medium 2 to a nip portion of the registration roller 3*g*.

The registration roller 3*g* performs a non-rotary operation for allowing the recording medium 2 to rest/wait and a rotary operation for feeding the recording medium 2 to the intermediate transfer belt 4*a* at a given sequence during an operation of image formation and registers between the toner image (developer image) during transfer step that is a next step and the recording medium 2.

(Process Cartridge)

Figure 2:
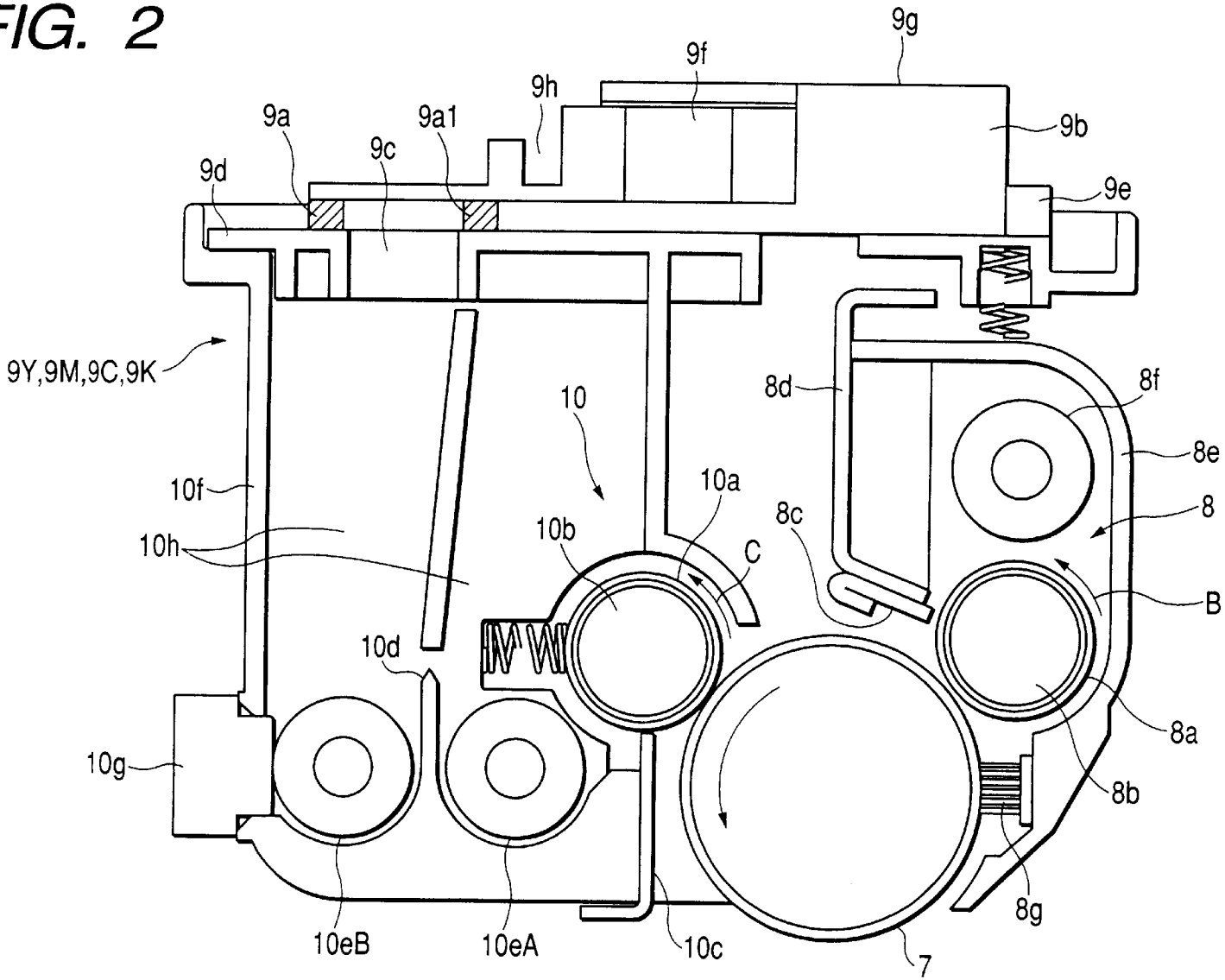
FIG. 2 is a cross-sectional view of a process cartridge of Embodiment 1.

In each of the process cartridges *9*Y, *9*M, *9*C, *9*K, the charging means 8 and the developing means 10 are placed around the photosensitive drum 7 as shown in FIG. 2 and they are integrally formed. The process cartridges *9*Y, *9*M, *9*C, *9*K can be easily detached by a user from the electrophotographic image forming apparatus body (referred to as "apparatus body" below) 100 and when the photosensitive drum 7 is no longer used, it is replaced.

In the present embodiment, for example, the rotation number of the photosensitive drum 7 is counted, and when the number exceeds a given count number, it is alarmed that the process cartridge is no longer used.

The photosensitive drum 7 is of a negatively charged organic photoconductor. The photosensitive drum 7 has a photoconductive layer that is usually used, on an aluminum drum substrate having a diameter of about 30 mm and provides a charge injection layer on the surface layer. And the photosensitive drum 7 is driven to rotate at a given process speed, about 117 mm/sec in this embodiment.

As the charge injection layer a coated layer of a material of an insulating resin binder into which, for example, $SnO_2$ ultra fine particles were dispersed as conductive fine particles is used.

A drum flange 7*b* is fixed to that side end portion of the photosensitive drum 7 (see FIG. 10), and a non-driving flange 7*d* is fixed to this side end portion. A drum shaft 7*a* is penetrated through the centers of the drum flange 7*b* and the non-driving flange 7*d,* and the drum shaft 7*a,* the drum flange 7*b* and the non-driving flange 7*d* are integrally rotated. That is, the photosensitive drum 7 is rotated about the axis of the drum shaft 7*a*.

This side end portion of the drum shaft 7*a* is rotatably supported with a bearing 7*e*. The bearing 7*e* is fixed to a bearing case 7*c*. And the bearing case 7*c* is fixed to a frame 9*d* of the process cartridges 9Y, 9M, 9C, 9K.

(Charging Means)

A charging means uses a contact charging process. In this embodiment, a magnetic brush charging device 8 using magnetic particles as a charging member is used.

The charging member concretely has a magnetic brush portion which was formed by magnetically confining conductive magnetic particles. The charging of the photosensitive drum is carried out by allowing the magnetic brush portion to contact the photosensitive drum 7 and applying a voltage to the photosensitive drum 7.

Such a charging process (charging of a member to be charged by directly injecting charges) is referred to as "an injection charging process". By using this injection charging process, a cleaner mechanism (cleaning blade, cleaning roller and the like) which mechanically scrapes off toner remaining on the photosensitive drum 7 to be removed became unnecessary. This cleanerless system is described later.

The injection charging process of the present embodiment does not utilize the discharge phenomenon in which the charging to a member to be charged is carried out by the use of a corona charger. Accordingly, an applied charging bias required for charging is only a desired surface potential of a member to be charged, and the injection charging process is a perfect ozoneless type charging which does not generate ozone and a low power consumption type charging.

Next, the magnetic brush charging device 8 of the present embodiment will be described with reference to FIG. 2.

(Magnetic Brush Charging Device)

The magnetic brush charging device 8 forms a magnetic brush layer of magnetic particles on a charging sleeve 8*a,* in which a magnet roller 8*b* was provided, and charges the photosensitive drum 7 to a desired potential through the contact portion of brush with the photosensitive drum 7.

The charging sleeve 8*a* is placed in such a manner that substantially a half left, periphery of the charging sleeve 8*a* is protruded into an opening portion of a charging container 8*e* containing magnetic particles in the longitudinal direction and substantially a half right periphery of the charging sleeve 8*a* is exposed outside. Irregularities are formed on a surface of the charging sleeve 8*a* by appropriately making the surface rough so that feeding of magnetic particles can be satisfactorily carried out.

The magnet roller 8*b* provided within the charging sleeve 8*a* is four-pole polarized in the circumferential direction. And magnetic particles are adhered to the photosensitive drum 7 and in order to prevent the adhered magnetic particles from being carried during rotation of the drum, the magnet roller 8*b* is fixed so that one pole, specifically, a S1 pole is opposed to the central direction of the photosensitive drum 7.

A non-magnetic plate-shaped regulating blade 8*c* is placed with a given gap between this regulating blade 8*c* and the surface of the charging sleeve 8*a*. The regulating blade 8*c* is supported on the charging container 8*e* through a supporting metallic plate 8*d*. Magnetic particles are held by the magnet roller 8*b* and are carried in a direction shown by an arrow B by a rotation of the charging sleeve 8*a*. And the magnetic particles form a magnetic brush portion on the charging sleeve 8*a* to a given thickness with the regulating blade 8*c*.

The charging sleeve 8*a* is oppositely placed with a given gap with respect to the photosensitive drum 7. The magnetic brush contacts the surface of the photosensitive drum 7 to form a charge nip portion. The width of the charge nip portion influences on the charging properties for the photosensitive drum 7. In the present embodiment, the gap is controlled so that the width of the charge nip portion is of about 6 mm.

The charging sleeve 8*a* is driven to rotate with a motor (not shown) in a direction shown by the arrow B in FIG. 2, which is a counter direction at the opposed portion with respect to the photosensitive drum 7 that is a member to be charged. In the present embodiment, when the rotary speed of the photosensitive drum 7 is $V_1$, the charging sleeve 8*a* is rotated at a speed ratio of $V_2 \equiv 1.5 \cdot V_1$ in the counter direction. The larger the relative rotary speed between the photosensitive drum 7 and the magnet brush portion becomes, the more the chance of contact increases. Accordingly, the charging uniformity is enhanced and the uptake properties of toner remaining after transfer to the magnetic brush can be enhanced.

To the magnetic brush portion i s applied a predetermined charging bias from a charging bias power supply (not shown) through the charging sleeve 8*a,* and the surface of the photosensitive drum 7 is contact-charging treated to a desired polarity and a potential in the charge nip portion.

As conductive magnetic particles forming the magnetic brush portion, magnetic metallic particles such as ferrite, magnetite and the like, and also such conductive magnetic particles bonded with resin can be used.

An agitating member 8*f* is rotatably supported with bearings between wall surfaces of both ends of the charging container 8*e* in the longitudinal direction so that it is placed in substantially parallel with the charging sleeve 8*a* and above the charging sleeve 8*a*.

A charging brush 8*g* contacts the surface of photosensitive drum 7 at an inroad amount of about 1 mm and applies a predetermined voltage thereto. By the contact of the charging brush 8*g*, the residual toner on the photosensitive drum 7 is uniformly dispersed, and a residual charge elimination is further performed, whereby the charging of the next setp is uniformly carried out.

Next, a cleanerless system in the reversal developing system in which the photosensitive drum is negatively charged and the negatively charged toner is developed on a lower potential portion of an exposure portion will be described.

(Cleanerless System)

First, particularly, a positively charged toner among the toner slightly remaining after transfer on the photosensitive drum is once electrostatically drawn in the magnetic brush charging device 8 and toner other than the above-mentioned toner is also collected by forcible scraping using a brush. And after the toner is negatively charged by friction with magnetic particles in the magnetic brush charging device 8, the toner is transferred onto the photosensitive drum 7.

On the other hand, the toner remaining negatively charged among the toner remaining after transfer is not almost drawn in the magnetic brush charging device 8 and is collected in the developing device 10 together with toner transferred from the magnetic brush charging device 8 (cleaning simultaneous with developing).

The drawing of toner into the developing device 10 in the cleaning simultaneous with developing is carried out by the fog removal bias (the fog removal potential difference that is a potential difference between the direct current voltage applied to the developing device 10 and the surface potential of the photosensitive drum 7).

According to this process, since the toner remaining after transfer is partially via the magnetic brush charging device 8 collected in the developing device 10 directly and then used in the next step and thereafter, the elimination of waste toner becomes possible and the inconvenience of maintenance can be decreased. Further, there increases a merit with respect to the space due to the cleanerless, whereby the image forming apparatus can be significantly miniaturized.

(Exposure Means)

In the present embodiment, exposure to the above-mentioned photosensitive drum 7 is carried out by the use of laser exposure means 1Y, 1M, 1C, 1K. That is, when an image signal is transmitted from the apparatus body 100, laser beam L modulated in response to this signal is applied to the uniformly charged surface of the photosensitive drum 7 by scanning (see FIG. 6), And an electrostatic latent image corresponding to the image information is selectively formed on the surface of the photosensitive drum 7.

Each of the laser exposure means 1Y, 1M, 1C, 1K is composed of a solid-state laser element (not shown), a polygon mirror 1*a*, imaging lens 1*b*, a reflective mirror 1*c*, and the like. The solid-state laser element is ON/OFF light emission controlled at a predetermined timing with a light emission signal generator (not shown) based on the inputted image signal. The laser beam L emitted from the solid-state laser element is converted to a substantially horizontal luminous flux with a collimator lens system (not shown) and is scanned with the polygon mirror 1*a* which is rotated at a high speed. And the luminous flux is imaged on the photosensitive drum 7 in a spot shape through the imaging lens 1*b* and the reflective mirror 1*c*.

Thus, the laser beam scanning exposure in the main scanning direction and the exposure in the sub-scanning direction due to the rotation of the photosensitive drum 7 are applied onto the surface of the photosensitive drum 7 to thereby obtain an exposure distribution in accordance with the image signal.

That is, by the irradiation and non-irradiation of laser beam L, a surface potential reduced light potential and a surface potential non-reduced dark potential are generated, respectively. And by contrast between the light potential and the dark potential an electrostatic latent image corresponding to the image information is formed.

(Developing Means)

The developing device 10, which is a developing means, is a two-component contact developing device (two-component magnetic brush developing device) and holds a developer composed of carrier and toner on a developing sleeve 10*a* which is a developer bearing member, in which a magnet roller 10*b* was provided. The developing sleeve 10*a* is provided with a regulating blade 10*c* with a predetermined gap therebetween. By the rotation of the developing sleeve 10*a* in a direction shown by an arrow C, a thin layer of the developer is formed on the developing sleeve 10*a*. The regulating blade 10*c* is supported and fixed to a developing container 10*f*.

The developing sleeve 10*a* is set in such a manner that it is placed in parallel so as to have a predetermined gap between the developing sleeve 10*a* and the photosensitive drum 7 and that during developing a developer formed on the developing sleeve 10*a* can develop in a state where the developer contacts the photosensitive drum 7. The developing sleeve 10*a* is driven to rotate in the developing portion at a predetermined peripheral speed in a counterclockwise direction shown by an arrow C, which is a counter direction to the rotation direction of the photosensitive drum 7.

The toner used in the present embodiment is a negatively charged toner with an average particle diameter of 6 $\mu$m. As a magnetic carrier, a magnetic carrier having a saturated magnetization of 205 emu/cm$^3$ ($205\times4\pi\times10^{-4}=8.2\pi\times10^{-2}$ Wb/m$^2$) and an average particle diameter of 35 $\mu$m is used. Further, as a developer, a mixture of toner and carrier mixed at the weight ratio of 6:94 is used.

Figure 10:
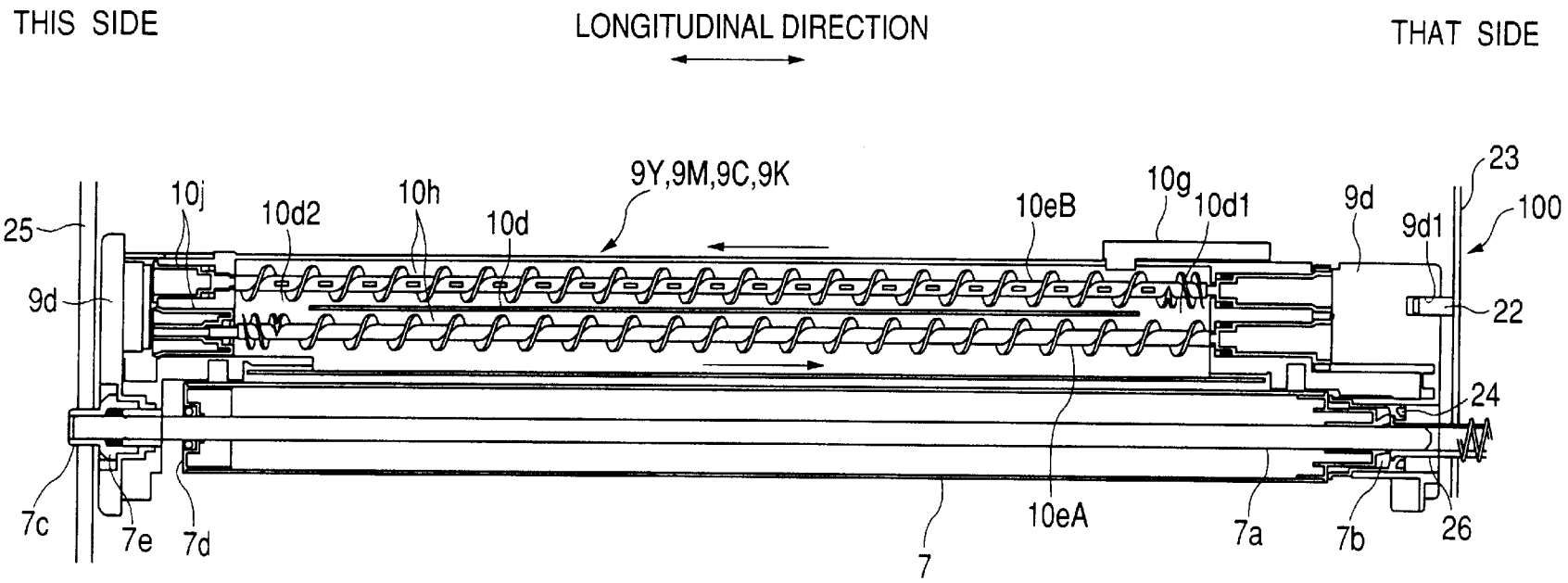
FIG. 10 is a longitudinal cross-sectional view of the process cartridge of Embodiment 1.

A developer containing portion 10*h* in which a developer is circulated is divided into two portions with a partition wall 10*d* positioned in the longitudinal direction except for both end portions of the developer containing portion 10*h*, as shown in FIGS. 2 and 10. Agitating screws 10*e*A, 10*e*B are placed so as to sandwich the partition wall 10*d*. The agitating screws 10*e*A, 10*e*B are rotatably supported on both side surfaces of the frame 9*d* of each of the process cartridges 9Y, 9M, 9C, 9K through a bearing 10*j*.

The toner replenished from toner replenishing containers 12Y, 12M, 12C, 12K used as the developer replenishing containers falls down on this side of the agitating screw 10*e*B and is agitated while being fed on that side in the longitudinal direction and is passed through a portion 10*d*1 without the partition wall 10*d* on that side end. Then the toner is further fed to this side in the longitudinal direction with the agitating screw 10*e*A and is passed through a portion 10*d*2 without the partition wall 10*d* on this side and is agitated while being fed with the agitating screw 10*e*B. Thus, the circulation is repeated.

Developing steps of visualizing an electrostatic latent image formed on the photosensitive drum 7 by the two-component magnetic brush process using the developing device 10 and the circulation system of developer will be described.

By the rotation of the developing sleeve 10*a,* a developer in a developing container 10*f* is drawn to the surface of the developing sleeve 10*a* with the N3 pole of the magnet roller 10*b* and is carried.

In the process of carrying the developer, the layer thickness of developer is regulated with the regulating blade 10*c* placed vertically to the developing sleeve 10*a,* and a thin layered developer is formed on the developing sleeve 10*a.* When the thin layered developer is carried to a developing pole N1 corresponding to the developing portion, an earing is formed by magnetic force. An electrostatic latent image on the surface of the photosensitive drum 7 is developed by toner in a developer which stands like the ears of rise as a toner image. The electrostatic latent image is reverse-developed in the present embodiment.

A thin layered developer on the developing sleeve 10*a,* which was passed through the developing portion is subsequently fed into the developing container 10*f* by the rotation of the developing sleeve 10*a* and is flaked from the surface of the developing sleeve 10*a* by the repulsion magnetic field in the N2 pole and the N3 pole to return to a developer reservoir in the developing container 10*f.*

A direct current (DC) voltage and an alternating current (AC) voltage are applied from a power supply (not shown) to the developing sleeve 10*a.* In the present embodiment, a DC voltage of −500 V and an AC voltage of peak-to-peak voltage of 1500 V in frequency of 2000 Hz is applied to develop selectively only on the exposed portion of photosensitive drum 7.

When the AC voltage is applied in the two-component developing process, the developing efficiency is generally increased and an image comes to have high quality. However, there arises a fear that fog may easily occur. Therefore, prevention of the fog is usually realized by providing the potential difference between the DC voltage applied to the developing sleeve 10*a* and the surface potential of the photosensitive drum 7. More specifically, the bias voltage of a potential difference between the potential of the exposed portion and the potential of the non-exposed portion of the photosensitive drum 7 is applied.

The potential difference for preventing the fog is called as a fog removal potential ($V_{back}$). By the potential difference, adhesion of toner to a non-image area (non-exposed portion) of the surface of the photosensitive drum 7 can be prevented during developing and toner remaining on the surface of the photosensitive drum 7 is collected in the cleanerless system (cleaning simultaneous with developing).

When toner is consumed by developing, the toner density in a developer is decreased. In the present embodiment a sensor 10*g* which detects the toner density is placed at a position in the vicinity of the outer periphery surface of the agitating screw 10*e*B. When the sensor 10*g* detects that the toner density in the developer is further decreased than a predetermined density level, an instruction to replenish toner from the toner replenishing containers 12Y, 12M, 12C, 12K to the developing device 10 is issued. By this toner replenishing operation the toner density in the developer can always be maintained and controlled at a predetermined level.

(Toner Replenishing Container)

The configuration of a toner replenishing container according to the present embodiment will be described by use of FIG. 1, FIG. 3, FIG. 5, FIG. 8, FIG. 9 and FIG. 11.

Figure 11:
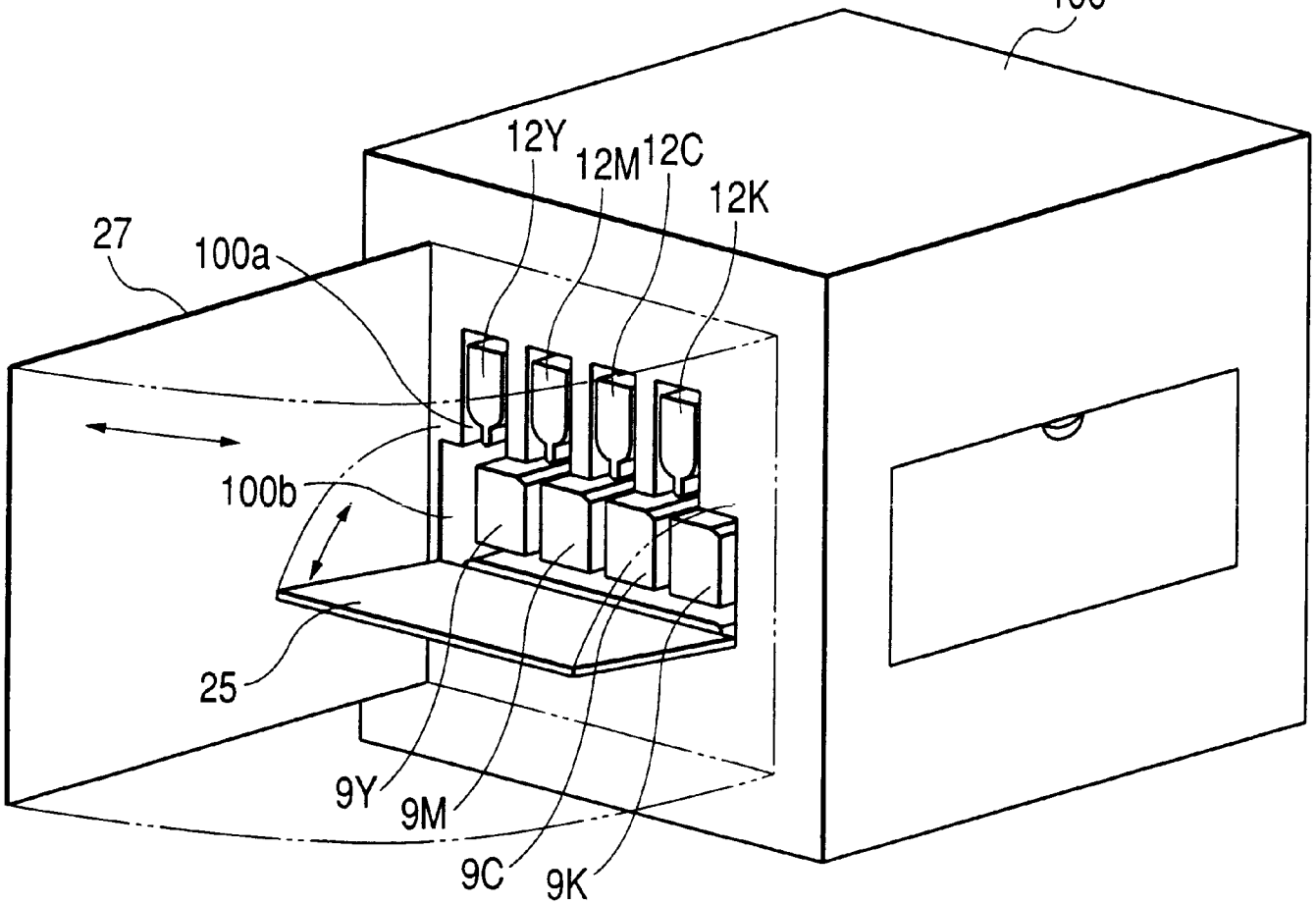
FIG. 11 is a schematic external perspective view of an electrophotographic image forming apparatus body of Embodiment 1.

The toner replenishing containers 12Y, 12M, 12C, 12K are placed above the process cartridges 9Y, 9M, 9C, 9K in parallel to each other and are mounted from the front side of the apparatus body 100 (see FIG. 11).

Figure 3:
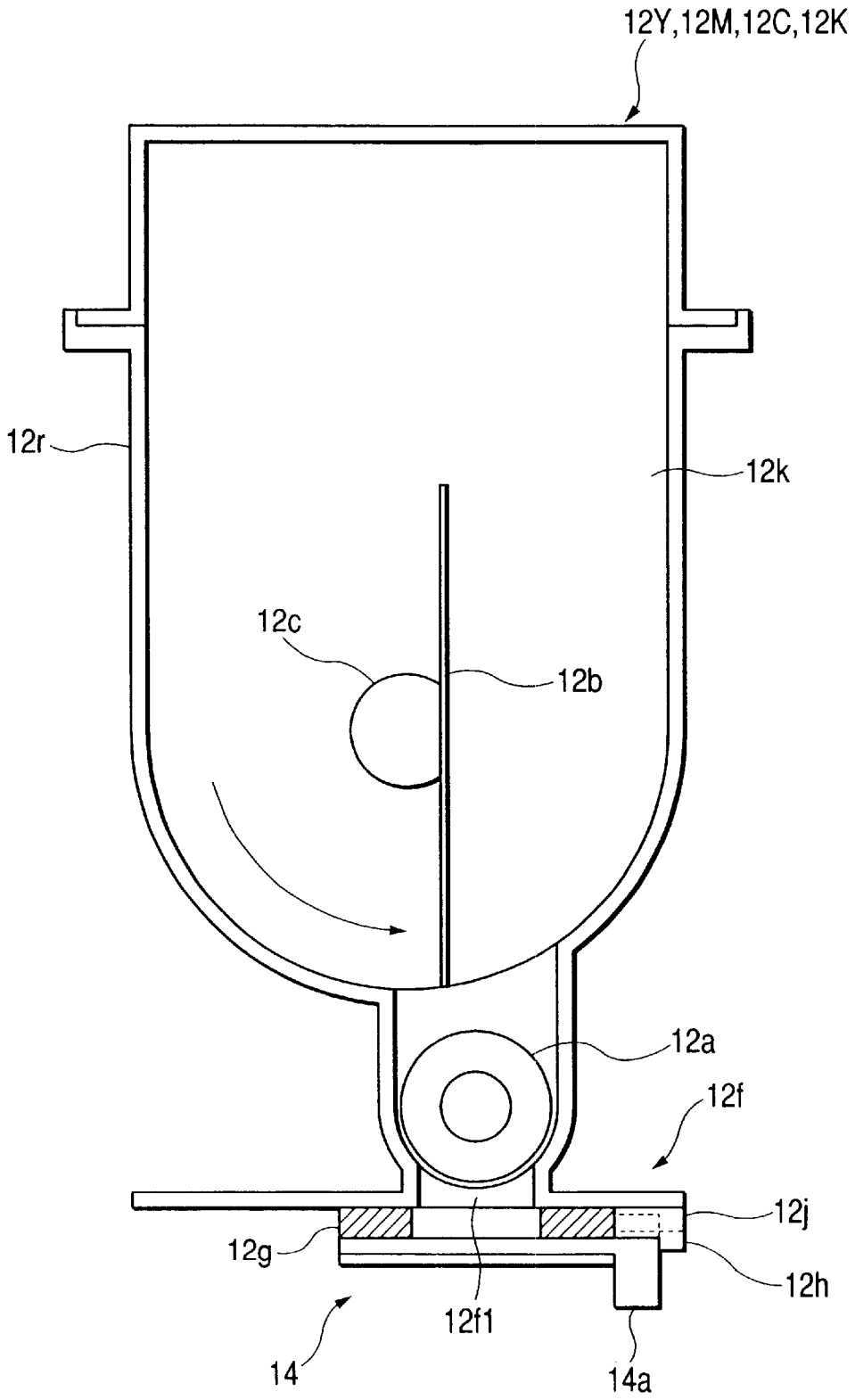
FIG. 3 is a cross-sectional view of a toner replenishing container of Embodiment 1.

Each of the toner replenishing containers 12Y, 12M, 12C, 12K has a toner containing portion 12*k* used as a developer containing portion, which contains toner in a frame 12*r,* as shown in FIG. 3. In the toner containing portion 12*k* are placed an agitating plate 12*b* used as a feeding member and fixed to an agitating shaft 12*c,* and a screw 12*a* used as a rotary member. And a discharge opening portion 12*f* used as a discharge opening and having an opening 12*f*1 for discharging toner is formed on the bottom of the container. The screw 12*a* and the agitating shaft 12*c* are rotatably supported with a bearing 12*d* in both ends thereof. A drive coupling (concave) 12*e* is placed on the leading end. The drive coupling (concave) 12*e* receives driving transmission from a drive coupling (convex) 24 and is driven to rotate.

Figure 9:
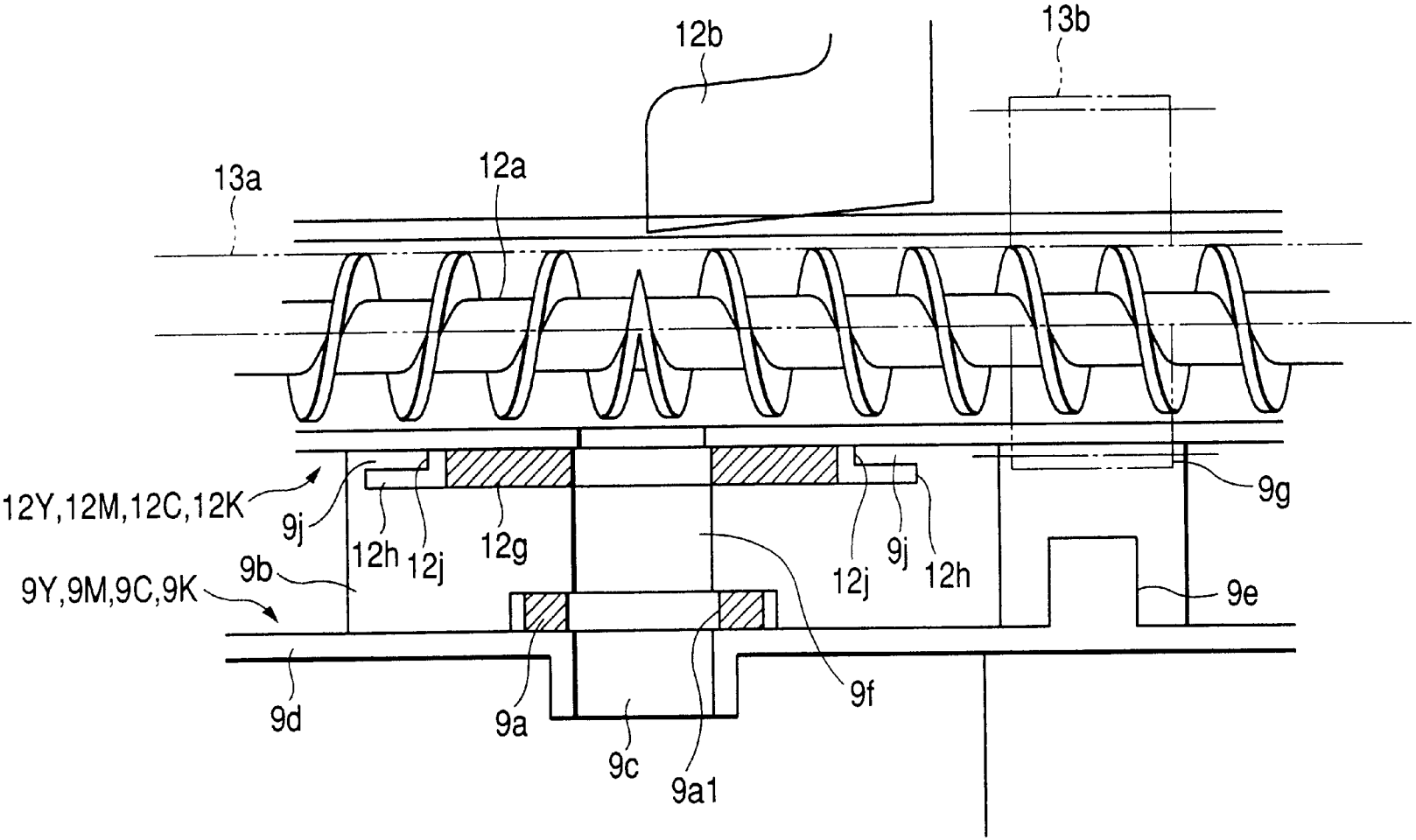
FIG. 9 is a detailed view (enlarged view of FIG. 8) of an opened state of a cartridge opening and closing member and a toner replenishing container opening and closing member.

The outside portion of the screw 12*a* has a spiral lib shape and the twist direction of the spiral shape is reversed while setting the discharge opening portion 12*f* as the center (see FIG. 9). By the rotation of the drive coupling (convex) 24, the screw 12*a* is rotated in a predetermined rotational direction. Toner is then fed toward the discharge opening portion 12*f* and is freely fell down from the opening of the discharge opening portion 12*f,* to whereby replenish toner to each of the process cartridges 9Y, 9M, 9C, 9K.

Figure 8:
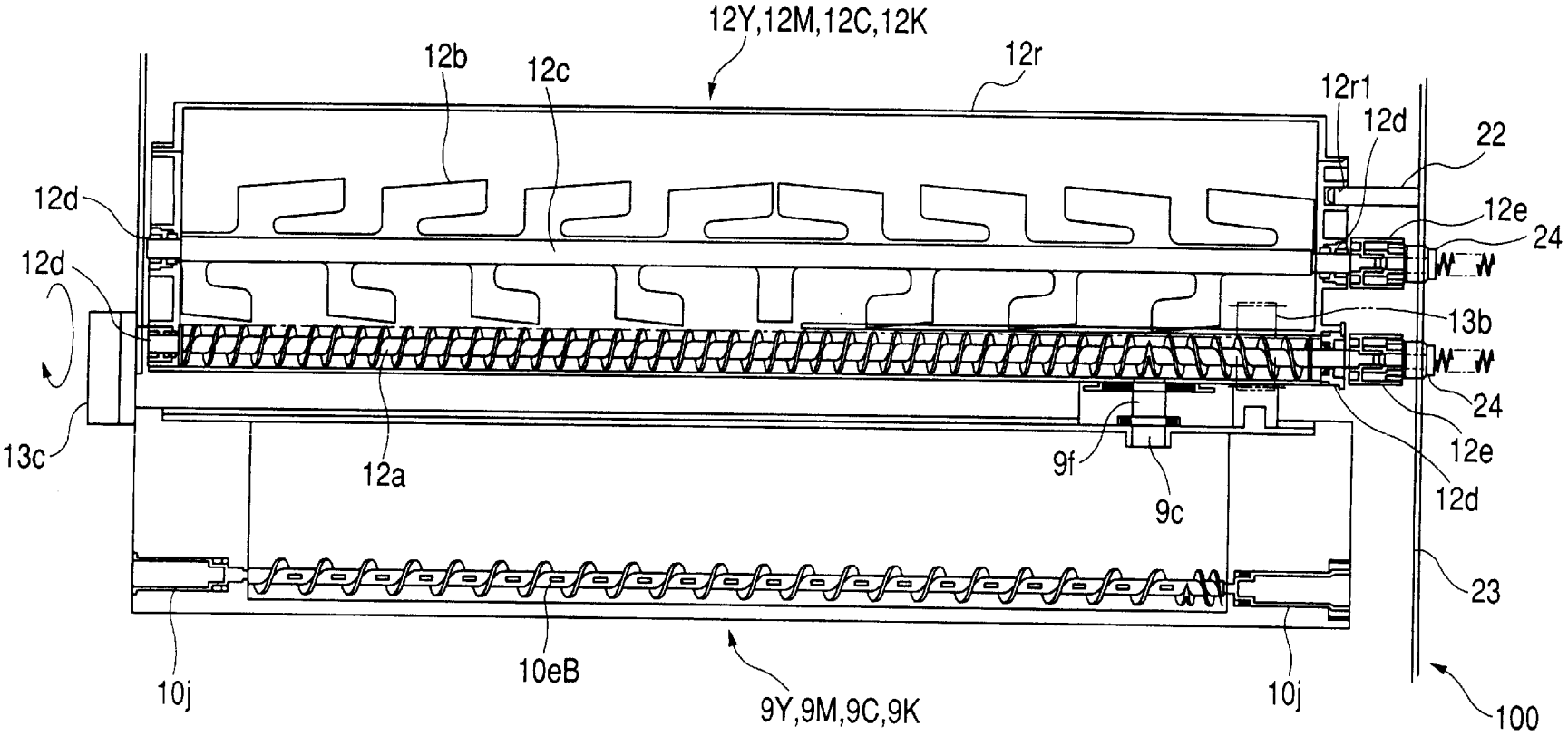
FIG. 8 is a longitudinal cross-sectional view of an engagement state (opened state) between the process cartridge and the toner replenishing container of Embodiment 1.

The leading end of the agitating plate 12*b* in the radial direction of rotation is slanted (see FIG. 8). When the leading end is brought into contact with the inner wall surface (the inner wall surface of a toner containing portion 12*k*) of each of the toner replenishing containers 12Y, 12M, 12C, 12K, it contacts the surface at an angle. Specifically, the leading end side of the agitating plate 12*b* is twisted to become spiral-shape. Thus, by the twist inclination on the leading end side of the agitating plate 12*b* is generated the feeding force in the axial direction of the agitating shaft 12*c* so that toner is fed in the longitudinal direction.

(Transfer Means)

An intermediate transfer unit, which is a transfer means, secondarily transfers a plurality of toner images, which were sequentially primarily transferred from the photosensitive drum 7 and overlapped, to the recording medium 2 by one operation. As shown in FIG. 1, the intermediate transfer unit 4 is provided with an intermediate transfer belt 4*a* running in a direction shown by an arrow, and the intermediate transfer belt 4*a* runs clockwise at a peripheral speed substantially the same as the outer peripheral speed of the photosensitive drum 7. The intermediate transfer belt 4*a* is an endless belt with a circumferential length of about 940 mm, and is looped through three rollers of a drive roller 4*b,* a secondary transfer opposed roller 4*g,* and a driven roller 4*c*. Further, transfer charging rollers 4*f*Y, 4*f*M, 4*f*C, 4*f*K are rotatably placed at positions respectively opposed to the photosensitive drum 7 and are pressurized in the respective central directions of the photosensitive drum 7.

The transfer charging rollers 4*f*Y, 4*f*M, 4*f*C, 4*f*K are energized from a high voltage power supply (not shown) to perform charging with polarity opposite to that of toner from the back side of the intermediate transfer belt 4*a* and primarily transfer the toner image on the photosensitive drums 7 to the upper surface of the intermediate transfer belt 4*a* sequentially.

A secondary transfer roller 4*d,* which is used as a transfer member, is in press-contact with the intermediate transfer belt 4*a* at a position opposed to the secondary transfer opposed roller 4*g* in the secondary transfer portion. The secondary transfer roller 4*d* can perform up-and-down motion in FIG. 1 and is also rotated. At this time bias is simultaneously applied to the secondary transfer roller 4*d,* so that the toner image on the intermediate transfer belt 4*a* is transferred to the recording medium 2.

Here, the intermediate transfer belt 4*a* and the secondary transfer roller 4*d* are respectively driven. When the recording medium 2 enters the secondary transfer portion, a given bias is applied to the secondary transfer roller 4*d* and the toner image on the intermediate transfer belt 4*a* is secondarily transferred to the recording medium 2.

While the transfer with the recording medium 2 sandwiched between the intermediate transfer belt 4*a* and the secondary transfer roller 4*d* is performed, the recording medium is conveyed at a given speed leftward in FIG. 1 to a fixing device 5, which is the next step.

At a given position on the intermediate transfer belt 4*a* on the most downstream side in the transfer process, a cleaning unit 11 contactable with and separatable from the surface of intermediate transfer belt 4*a* is provided. The cleaning unit 11 removes toner remaining after the secondary transfer.

A cleaning blade 11*a* for removing the toner remaining after the secondary transfer is placed in the cleaning unit 11. The cleaning unit 11 is swingably mounted at the rotation center (not shown). The cleaning blade 11*a* is in press-contact with the intermediate transfer belt 4*a* in inroading direction. The transfer residual toner drawn into the cleaning unit 11 is carried to a waste toner tank (not shown) with a feeding screw 11*b* to be stored therein.

As the intermediate transfer belt 4*a,* an intermediate transfer belt made of polyimide resin can be used. The material of the intermediate transfer belt 4*a* is not limited to the polyimide resin, and plastics such as polycarbonate resin, polyethylene terephthalate resin, polyvinylidene fluoride resin, polyethylene naphthalate resin, polyether ether ketone resin, polyether sulfone resin, and polyurethane resin, and fluorine series rubber and silicone series rubber can be preferably used.

(Fixing Portion)

A toner image formed on the photosensitive drum 7 with the developing means 10 is transferred to the recording medium 2 through the intermediate transfer belt 4*a*. Then the fixing device 5 fixes the toner image transferred to the recording medium 2 with heat.

As shown in FIG. 1, the fixing device 5 is provided with a fixing roller 5*a* for imparting heat to the recording medium 2 and a pressure roller 5*b* for press-contacting the recording medium 2 with the fixing roller 5*a*. Each of the rollers 5*a,* 5*b* is a hollow roller and has a heater (not shown) therein. The rollers are driven and rotated to feed the recording medium simultaneously.

That is, the recording medium 2 holding the toner image is conveyed with the fixing roller 5*a* and the pressure roller 5*b* and at the same time the toner image is fixed to the recording medium 2 by applying heat and pressure. The fixed recording medium 2 is discharged through discharge rollers 3*h,* 3*j* and is stacked on a tray 6 on the apparatus body 100.

(Mounting of Process Cartridge and Toner Replenishing Container)

Next, mounting procedures of the process cartridge and the toner replenishing container will be described with reference to FIG. 6, FIG. 8, FIG. 10 and FIG. 11.

As shown in FIG. 11, a front door 27 that is openable as shown by an arrow is provided in the front of the apparatus body 100. When the front door 27 is opened on this side, opening portions 100*a,* 100*b* for separately inserting the process cartridges 9Y, 9M, 9C, 9K and the toner replenishing containers 12Y, 12M, 12C, 12K are exposed.

A centering plate 25 that is pivotably supported as shown by an arrow is placed on the opening portion 100*b* for inserting the process cartridges 9Y, 9M, 9C, 9K. When the process cartridges 9Y, 9M, 9C, 9K are inserted or removed, the centering plate 25 is first opened before the insertion or the removal.

Figure 6:
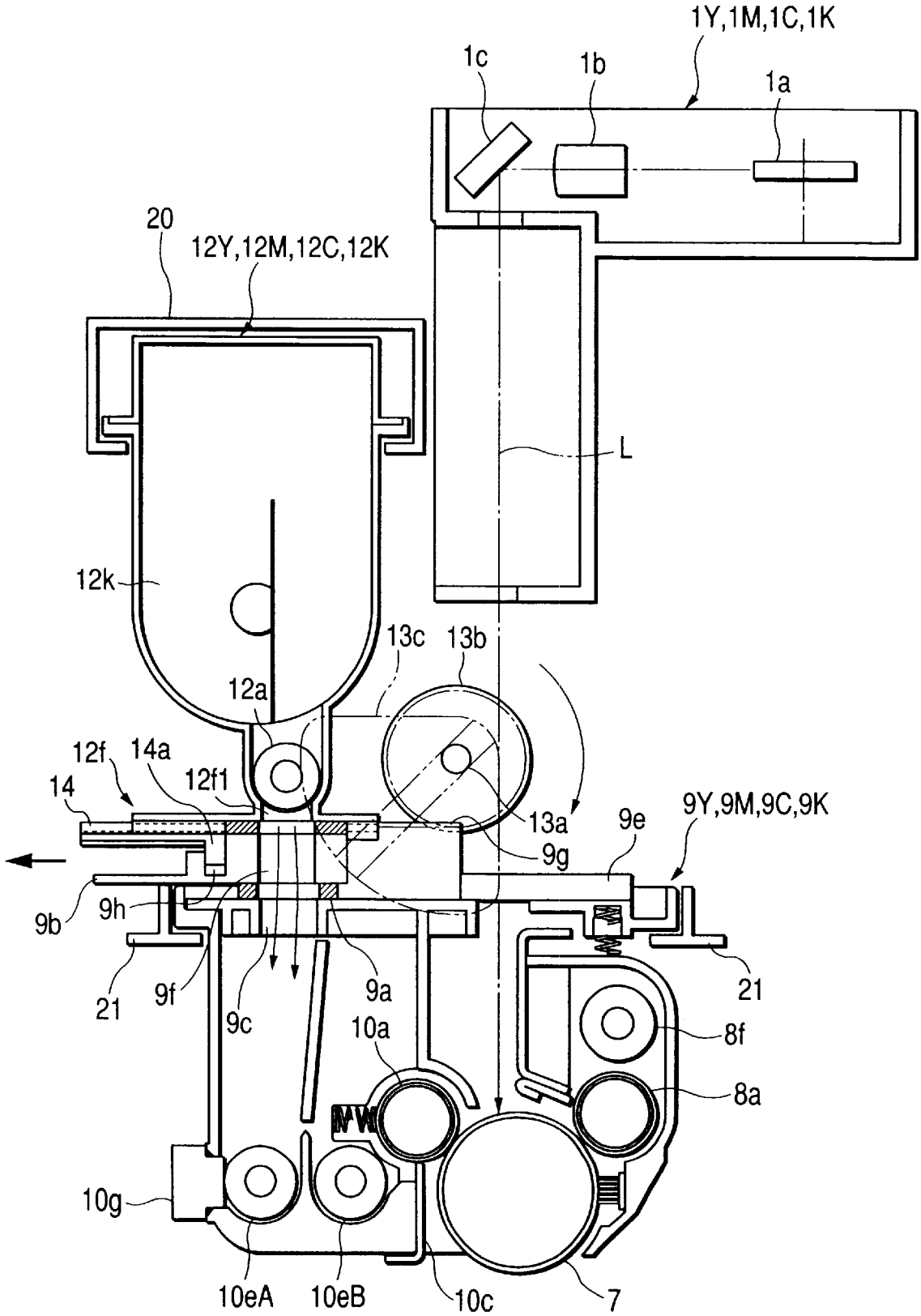
FIG. 6 is a cross-sectional view of an engagement state (opened state) between the process cartridge and the toner replenishing container of Embodiment 1.

In the apparatus body 100, as shown in FIG. 6, guide rails 21 which are used as a cartridge mounting means serving as a guide for attachably/detachably mounting the process cartridges 9Y, 9M, 9C, 9K, and a guide rail 20 which is used as a container mounting means serving as a guide for attachably/detachably mounting the toner replenishing containers 12Y, 12M, 12C, 12K, are fixed.

A direction of mounting the process cartridges 9Y, 9M, 9C, 9K is parallel to the axial direction of the photosensitive drum 7, and a direction of mounting the toner replenishing containers 12Y, 12M, 12C, 12K is parallel to the axial direction of the screw 12*a*. The guide rails 21, 20 are placed in the same direction as the mounting direction. The process cartridges 9Y, 9M, 9C, 9K and the toner replenishing containers 12Y, 12M, 12C, 12K are slid and inserted from this side in the apparatus body 100 to that side along the guide rails 21, 20.

When the process cartridges 9Y, 9M, 9C, 9K are completely inserted into the most inner portion, as shown in FIG. 10, the drum shaft 7*a* on that side end is inserted into a centering shaft 26 of the apparatus body 100, and the center position of rotation on that side of the photosensitive drum 7 is determined with respect to the apparatus body 100. At the same time, a drum flange 7*b* and a drive coupling (convex) 24 are connected so that the photosensitive drum can be driven and rotated. Further, a support pin 22 for positioning the process cartridges 9Y, 9M, 9C, 9K is arranged on a back side plate 23. This support pin 22 is inserted in a concave portion 9*d*1 provided on the frame 9*d* of the process cartridges 9Y, 9M, 9C, 9K so that the position of the frame 9*d* of the process cartridges 9Y, 9M, 9C, 9K is fixed.

The pivotable centering plate 25 is placed on this side of the apparatus body 100. A bearing case 7*c* of the process cartridges 9Y, 9M, 9C, 9K is supported and fixed to this centering plate 25. By such a series of inserting operations, the photosensitive drum 7 and the process cartridges 9Y, 9M, 9C, 9K can be positioned with respect to the apparatus body 100.

Therefore, the drum shaft 7*a,* drum flange 7*b,* concave portion 9*d*1, and bearing case 7*c* form a positioning portion for positioning the process cartridges 9Y, 9M, 9C, 9K with respect to the apparatus body 100.

On the other hand, when the toner replenishing containers 12Y, 12M, 12C, 12K are completely inserted to the inner portion as shown in FIG. 8, the support pin 22 protruding from the back side plate 23 is inserted into a concave portion 12*r*1 provided on that side wall surface of a frame 12*r,* whereby the position of the frame 12*r* of the toner replenishing containers 12Y, 12M, 12C, 12K is fixed. At the same time, a drive coupling (concave) 12*e* and the drive coupling (convex) 24 are connected to each other and the screw 12*a* and the agitating shaft 12*c* can be driven and rotated.

Figure 30:
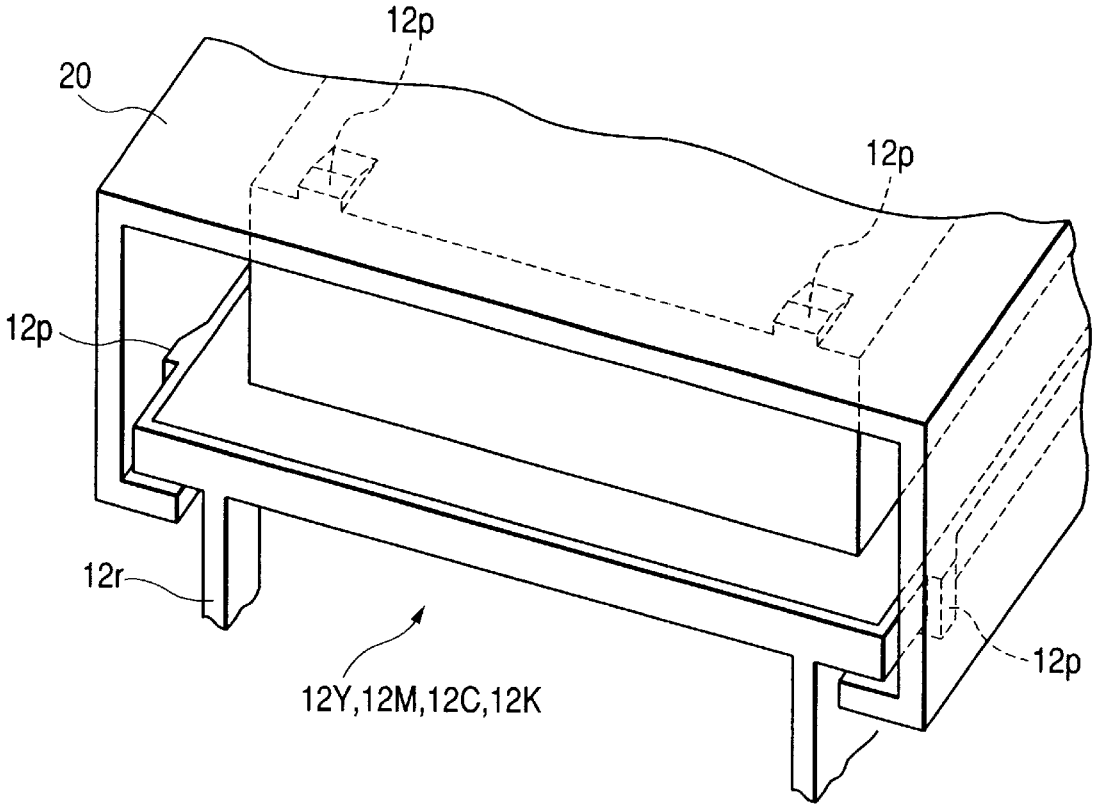
FIG. 30 is a schematic perspective view of positioning of the toner replenishing container of Embodiment 1.
Figure 31:
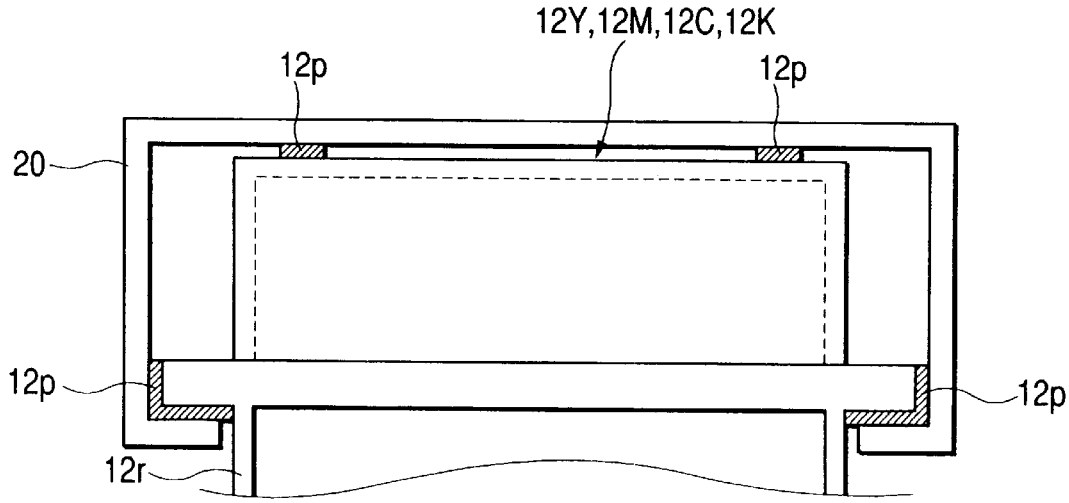
FIG. 31 is a schematic view of positioning of a toner replenishing container of Embodiment 1.

Further, as shown in FIGS. 30 and 31, a plurality of protrusions 12*p* are formed on this side wall surface of the frame 12*r* of the toner replenishing containers 12Y, 12M, 12K. These protrusions 12*p* engage with the inner wall of the opening portion of the guide rail 20. And by the engagement of the opening portion of the guide rail 20 with the protrusions 12*p* determines this side position of the toner replenishing containers 12Y, 12M, 12C, 12K.

Therefore, the support pin 22, drive coupling (concave) 12*e,* and protrusions 12*p* form a positioning portion for positioning the toner replenishing containers 12Y, 12M, 12C, 12K with respect to the apparatus body 100.

(Explanation of the Structure for Replenishing Toner)

First, configurations of a replenishing opening portion of the process cartridge and the cartridge opening and closing member will be described with reference to FIG. 2, FIG. 4, FIG. 19, FIG. 20, and FIG. 23.

Figure 4:
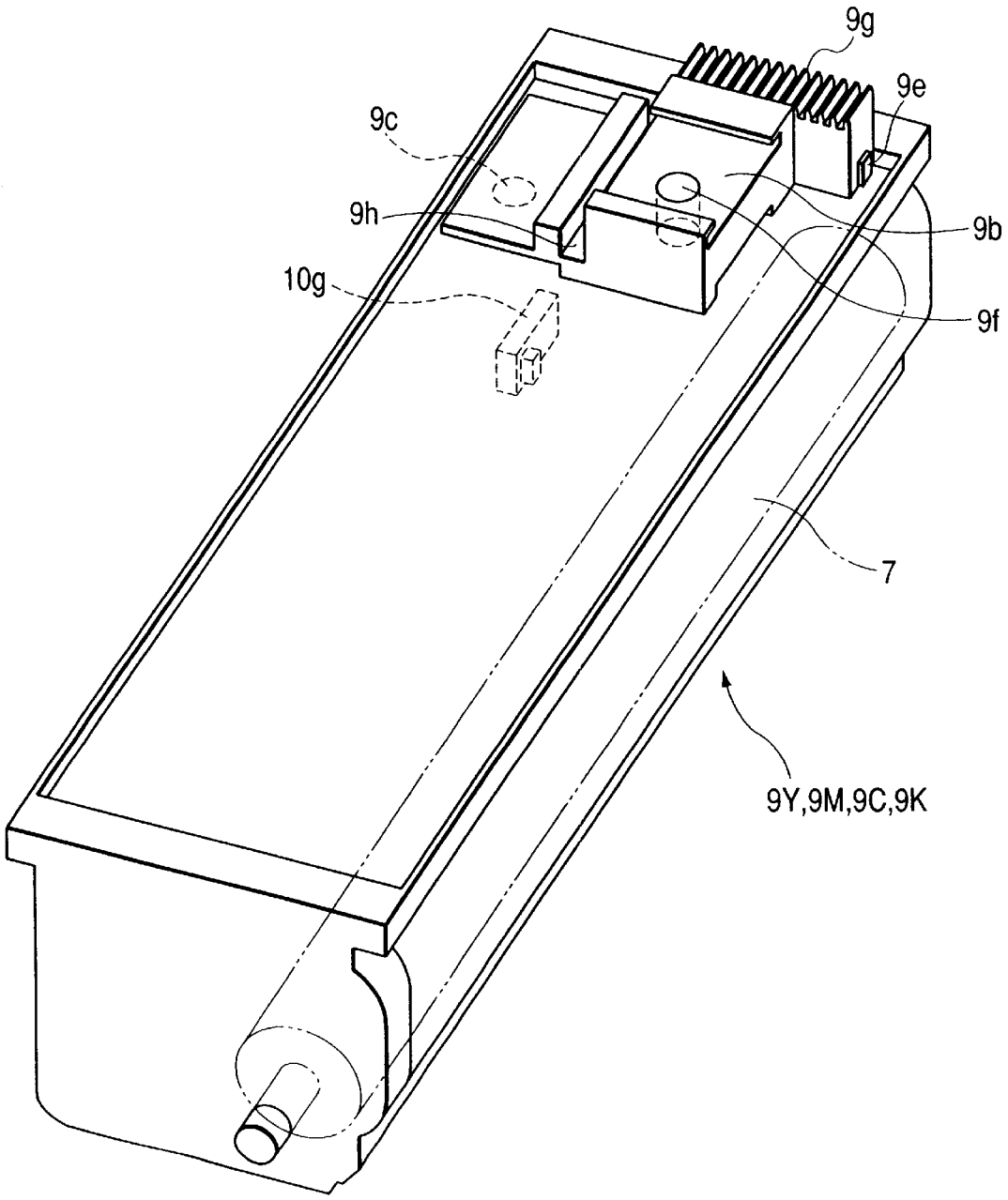
FIG. 4 is a schematic external perspective view of the process cartridge of Embodiment 1.

As shown in FIG. 2 and FIG. 4, on the upper surface of a frame 9*d* forming a part of the process cartridges 9Y, 9M, 9C, 9K, a replenishing opening portion 9*c* which is used as a developer receiving opening that is a hole for receiving toner from the toner replenishing containers 12Y, 12M, 12C, 12K is placed. In this embodiment, the replenishing opening portion 9*c* is placed on that side (near the forefront) in a direction of inserting the process cartridges 9Y, 9M, 9C, 9K, that is on the drive transmission side of the photosensitive drum 7.

In the periphery of the replenishing opening portion 9*c,* a sealing member 9*a* is adhered and fixed to the upper surface of the frame 9*d.* In the sealing member 9*a,* an opening 9*a*1 having substantially the same shape as the hole of the replenishing opening portion (opening) 9*c* is formed. A guide rib 9*e* and a cartridge opening and closing member 9*b* are placed on the frame 9*d* on the drive input side for driving the developing device 10 (on that side in the direction of inserting the process cartridge). The guide rib 9*e* is extended in a direction perpendicular to the axial direction of the developing sleeve 10*a.* The cartridge opening and closing member (shutter member) 9*b* slidably engages with the guide rib 9*e.*

Before use of the process cartridges 9Y, 9M, 9C, 9K, the sealing member 9*a* for the replenishing opening portion 9*c* tightly adheres to the cartridge opening and closing member 9*b* and the opening 9*a*1 is closed (see FIG. 2).

Figure 23:
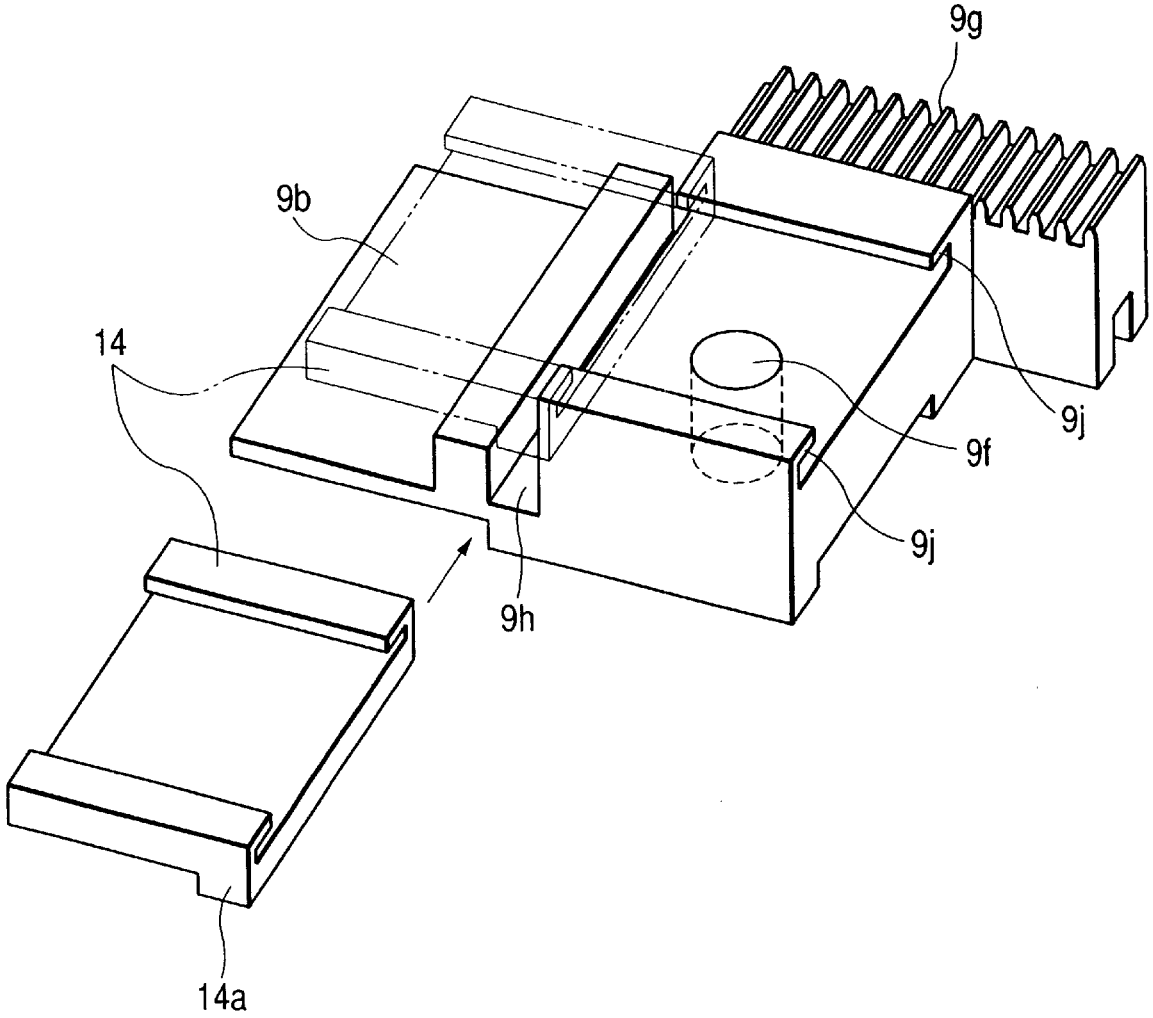
FIG. 23 is an explanatory view of a state before the engagement of a cartridge opening and closing member, and a toner replenishing container opening and closing member.

The first cartridge engagement portion (concave) 9*h* and the second cartridge engagement portion (convex) 9*j* are formed on the cartridge opening and closing member 9*b* as shown in FIG. 4 and FIG. 23.

In this embodiment, a convex rib on the uppermost surface is the second cartridge engagement portion (convex) 9*j,* and a concave portion perpendicular to the above-mentioned convex portion is the first cartridge engagement portion (concave) 9*h.* Note that the second cartridge engagement portion (convex) 9*j* is extended in a direction perpendicular to the axial direction of the developing sleeve 10*a,* and the first cartridge engagement portion (concave) 9*h* is extended in the axial direction of the developing sleeve 10*a.*

In the cartridge opening and closing member 9*b,* an opening 9*f* for communicating the replenishing opening portion 9*c* with an opening 12*f*1 of the discharge opening portion 12*f* of the toner replenishing containers 12Y, 12M, 12C, 12K is provided. Further, a rack 9*g* which is used as a release portion is integrally formed in the cartridge opening and closing member 9*b.* The rack 9*g* receives a driving force from an opening and closing gear (large) 13*b* used as a driving member and placed in the apparatus body 100, as shown in FIG. 20.

Figure 20:
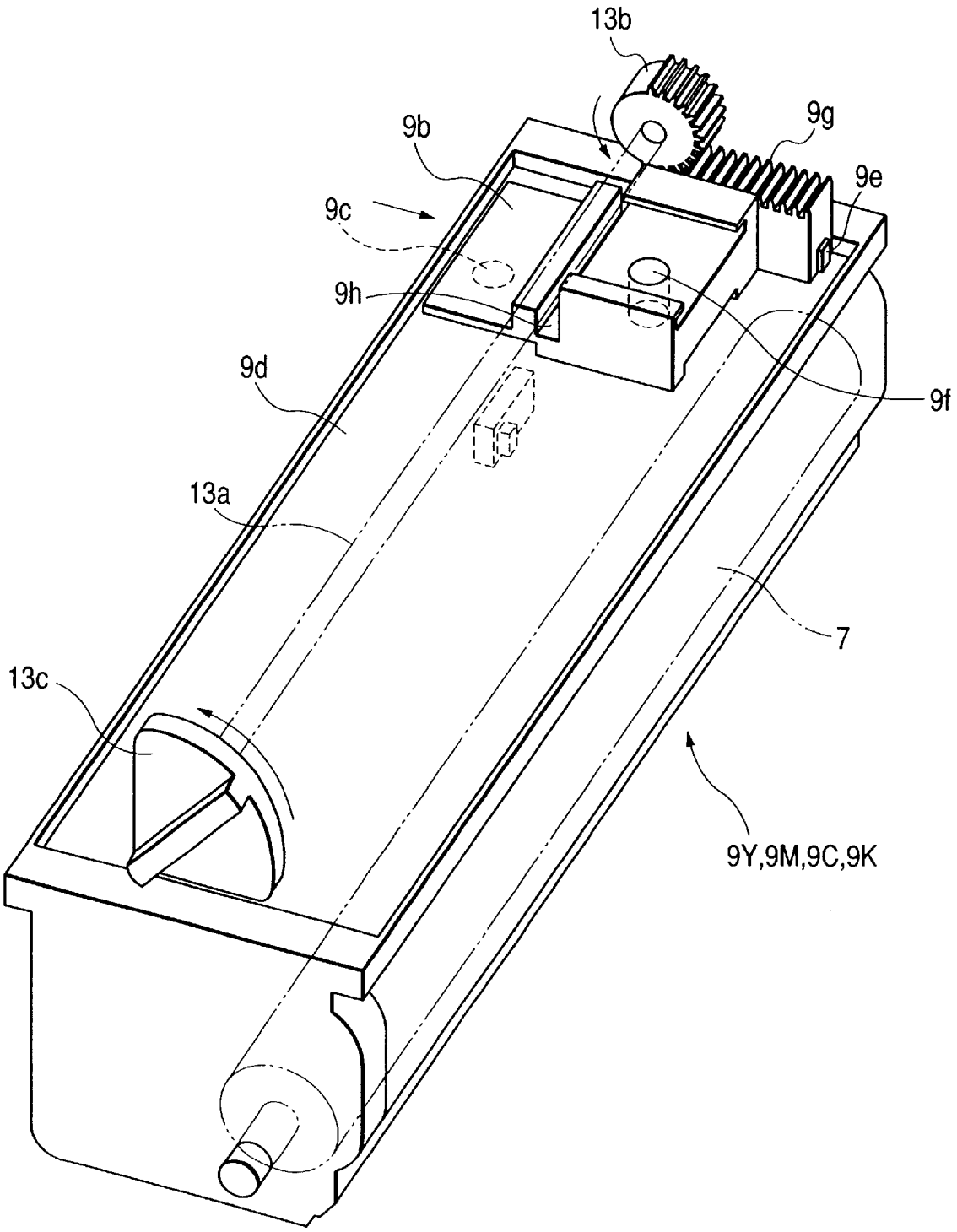
FIG. 20 is a schematic external perspective view (sealed state) of the process cartridge of Embodiment 1.

As shown in FIG. 20, a rotary shaft 13*a* of the opening and closing gear 13*b* is placed above the process cartridges 9Y, 9M, 9C, 9K, in parallel to the axis of the photosensitive drum 7. The above-mentioned opening and closing gear (large) 13*b* is fixed to the axis end on that side. To the axis end of this side, a rotary lever 13*c* is fixed. Further, the rotary shaft 13*a* is rotatably supported with a bearing (not shown) in the apparatus body 100.

When the rotary lever 13*c* is rotated, for example manually, the opening and closing gear (large) 13*b* is rotated through the rotary shaft 13*a* while interlocked therewith. Then, when each of the process cartridges 9Y, 9M, 9C, 9K is inserted into the apparatus body 100 and is set at a given position, the opening and closing gear (large) 13*b* engages with the teeth of rack 9*g* at a given phase, as shown in FIG. 20. And by the rotary driving of the opening and closing gear (large) 13*b,* the rack 9*g* receives a driving force and is slid in the axial direction of guide rib 9*e* (a direction perpendicular to the axial direction of the developing sleeve 10*a*).

Figure 19:
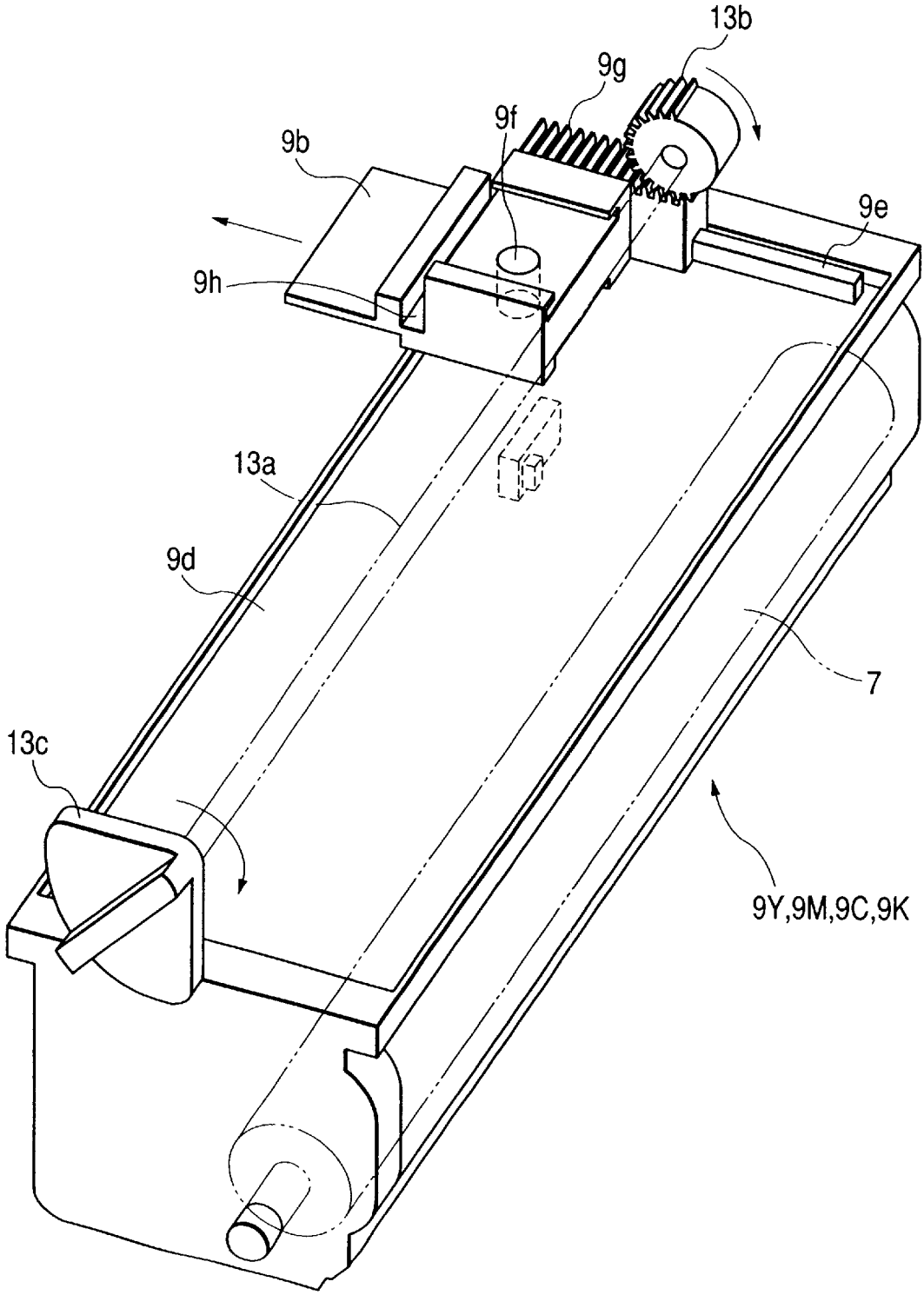
FIG. 19 is a schematic external perspective view (opened state) of the process cartridge of Embodiment 1.

In a state where the process cartridges 9Y, 9M, 9C, 9K are set in the apparatus body 100, when the rotary lever 13*c* is rotated clockwise, the cartridge opening and closing member 9*b* is slid leftward through the rotary shaft 13*a* and the opening and closing gear (large) 13*b* (see FIG. 19). When the rotary lever is rotated counterclockwise under this state the cartridge opening and closing member 9*b* is slid rightward and is returned to the original position (see FIG. 20). That is, by the rotation of the rotary lever 13*c* the cartridge opening and closing member 9*b* is slid in a direction perpendicular to the axial direction of the developing sleeve 10*a* so that it moves freely between the first position (released or opened position (see FIG. 19)) which opens the replenishing opening portion 9*c* and the second position (sealed or closed position (see FIG. 20)) which closes or seals the replenishing opening portion 9*c.*

Next, configurations of a discharge port of the toner replenishing container and a toner replenishing container opening and closing member will be described with reference to FIG. 3, FIG. 5, FIG. 9, FIG. 21, and FIG. 22.

Figure 5:
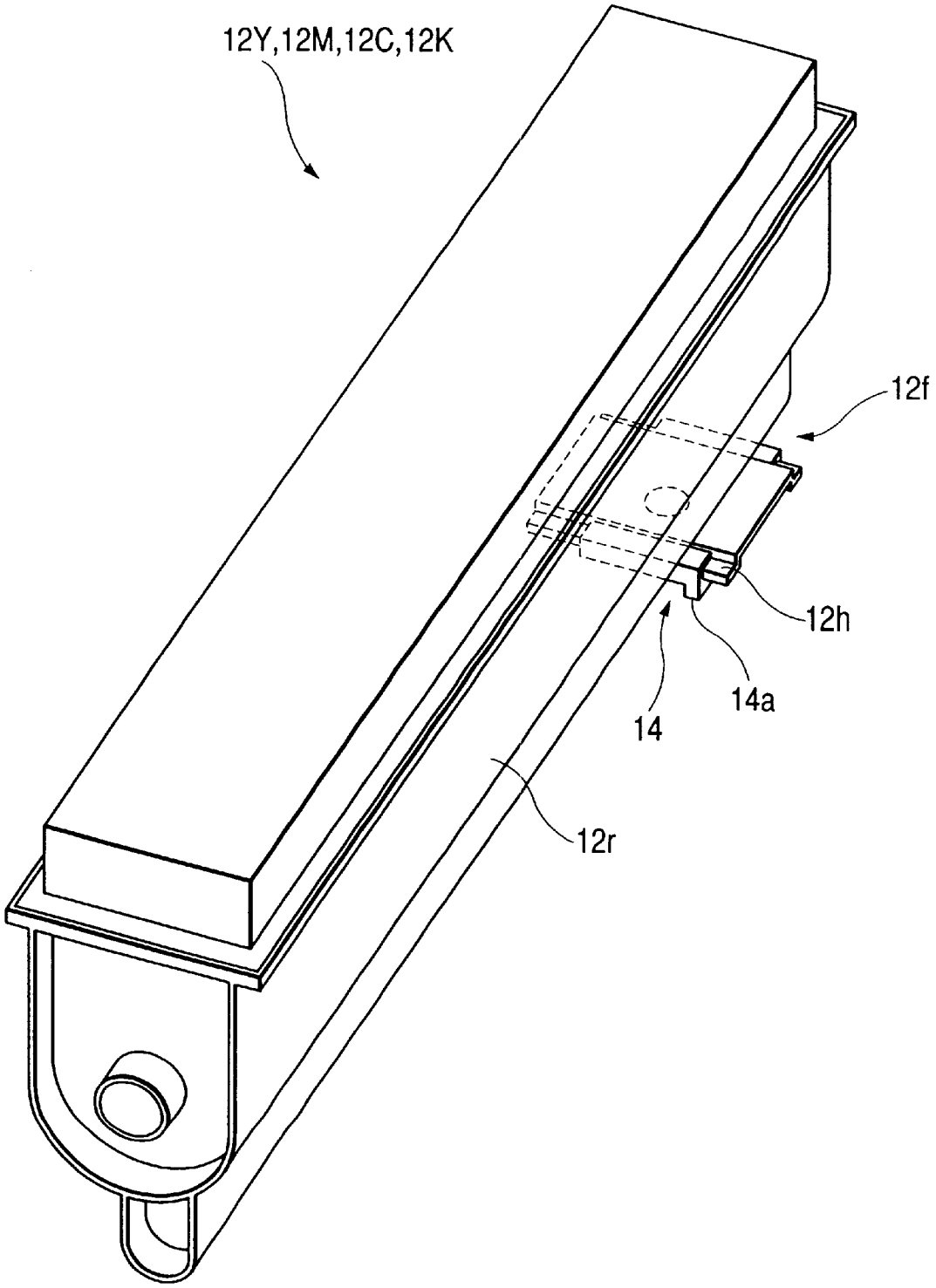
FIG. 5 is a schematic external perspective view of the toner replenishing container of Embodiment 1.

In a part of the bottom of the toner replenishing containers 12Y, 12M, 12C, 12K, the discharge opening portion 12*f* for discharging toner outside the container is provided, as shown in FIG. 3 and FIG. 5. At the center of the discharge opening portion 12*f,* an opening 12*f*1 as a discharge opening is formed. A sealing member 12*g* is adhered to the bottom portion of each of the toner replenishing containers 12Y, 12M, 12C, 12K so as to surround the periphery of the opening 12*f*1. In this embodiment, the discharge opening portion 12*f* is placed on that side of the toner replenishing containers 12Y, 12M, 12C, 12K (near the forefront in a direction of inserting the containers into the apparatus body 100) which is on the drive transmission side of the screw 12*a.*

Figure 22:
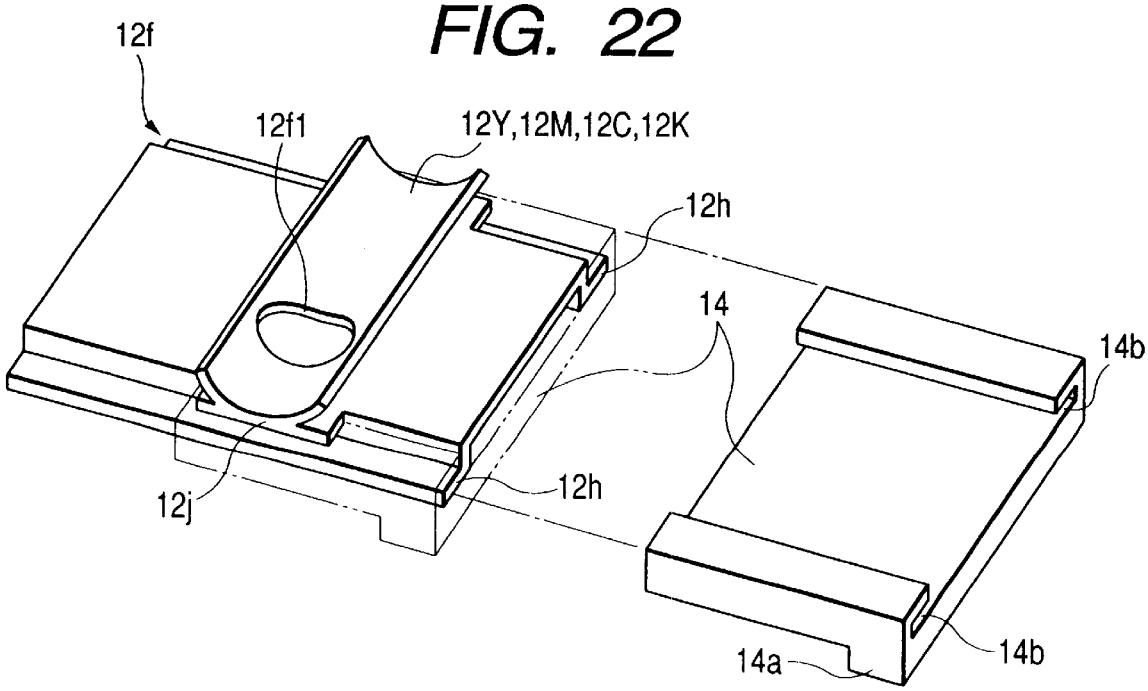
FIG. 22 is an explanatory view of a state (sealed state) before the engagement of a toner replenishing container opening and closing member, and a discharge opening portion.

As shown in FIG. 3, FIG. 5, and FIG. 22, in the periphery of the discharge opening portion 12*f* on the bottom of the toner replenishing containers 12Y, 12M, 12C, 12K are formed the first toner replenishing container engagement portion (convex) 12*h* and the second toner replenishing container engagement portion (concave) 12*j* used as a replenishing container engagement portion. The toner replenishing container engagement portions 12*h,* 12*j* form an integral rail with concave and convex combined, which is extended in a direction perpendicular to the axial direction of the developing sleeve 10*a.* In this embodiment, a convex rib on the lowermost surface is the first toner replenishing container engagement portion (convex) 12*h* and a concave portion just above the convex is the second toner replenishing container engagement portion (concave) 12*j.*

A toner replenishing container opening and closing member 14 (shutter member) used as a replenishing container opening and closing member engages with the discharge opening portion 12*f* on the lower side of the discharge opening portion 12*f,* that is, the drive input side for driving the agitating plate 12*b* (that side in a direction of inserting the toner replenishing container) so that the opening 12*f*1 can be opened and closed. Thus, the toner replenishing container opening and closing member 14 can be moved between the first position (opened or released position) for opening the opening 12*f*1 of the discharge opening portion 12*f* and the second position (sealed or closed position) for sealing and closng the opening 12*f*1.

In the toner replenishing container opening and closing member 14 are formed a first driving force receiving portion 14*a* (convex) for opening and closing the toner replenishing container and a second driving force receiving portion 14*b* (concave) for opening and closing the toner replenishing container, which are used as driving force receiving portions. In this embodiment, a concave rib on the uppermost surface is the second driving force receiving portion 14*b* (concave), and a convex rib perpendicular to the concave rib is the first driving force receiving portion 14*a* (convex) for opening and closing the toner replenishing container. Note that the second driving force receiving portion 14*b* (concave) for opening and closing the toner replenishing container is extended in a direction perpendicular to the axial direction of the screw 12*a,* and the first driving force receiving portion 14*a* (convex) for opening and closing the toner replenishing container is extended in the axial direction of the screw 12*a* to protrude downward (on the process cartridge side).

Figure 21:
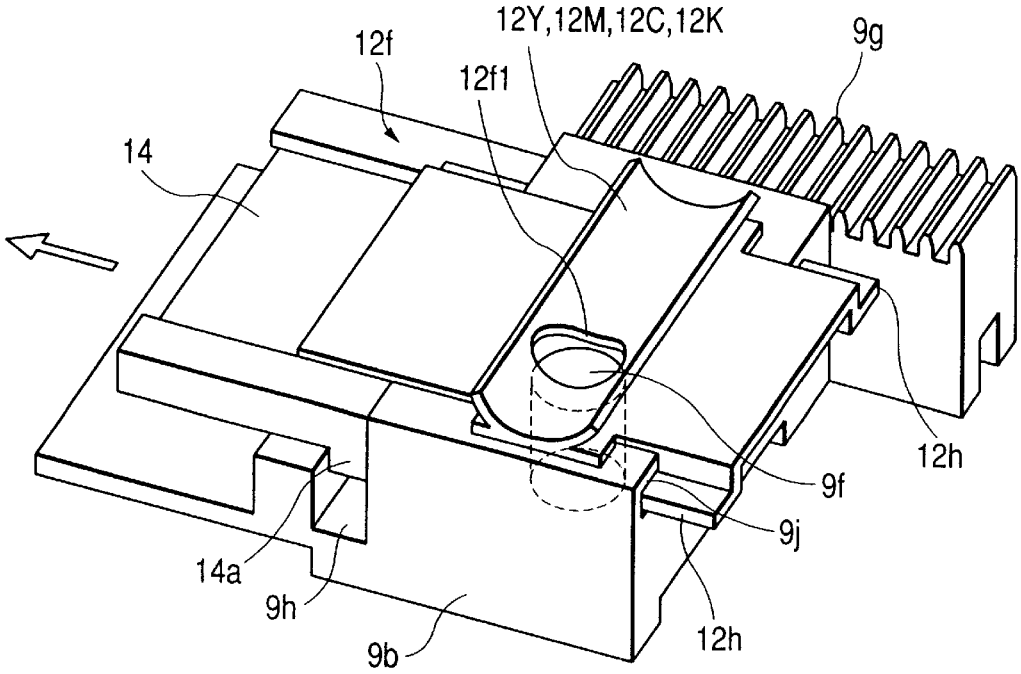
FIG. 21 is an explanatory view of an engagement state (opened state) between a cartridge opening and closing member, a toner replenishing container opening and closing member, and a discharge opening portion.

The toner replenishing container opening and closing member 14 is slid in a direction perpendicular to the axial direction of the screw 12*a* with respect to the discharge opening portion 12*f* of the toner replenishing containers 12Y, 12M, 12C, 12K, by inserting the above-mentioned second driving force receiving portion 14*b* (concave) for opening and closing the toner replenishing container into the first toner replenishing engagement portion (convex) 12*h* of the toner replenishing containers 12Y, 12M, 12C, 12K (see FIG. 21 and FIG. 22). Accordingly, the toner replenishing container opening and closing member 14 can be moved between the first position for opening the opening 12*f*1 of the discharge opening portion 12*f* and the second position for sealing or closing the opening 12*f*1.

Next, toner replenishing from the toner replenishing container to the process cartridge will be described with reference to FIG. 6, FIG. 7, FIG. 8, FIG. 9, FIG. 21, FIG. 22, and FIG. 23.

Here, a case where the process cartridges 9Y, 9M, 9C, 9K are inserted in the apparatus body 100, and then the toner replenishing containers 12Y, 12M, 12C, 12K are inserted therein (see FIG. 8).

Figure 7:
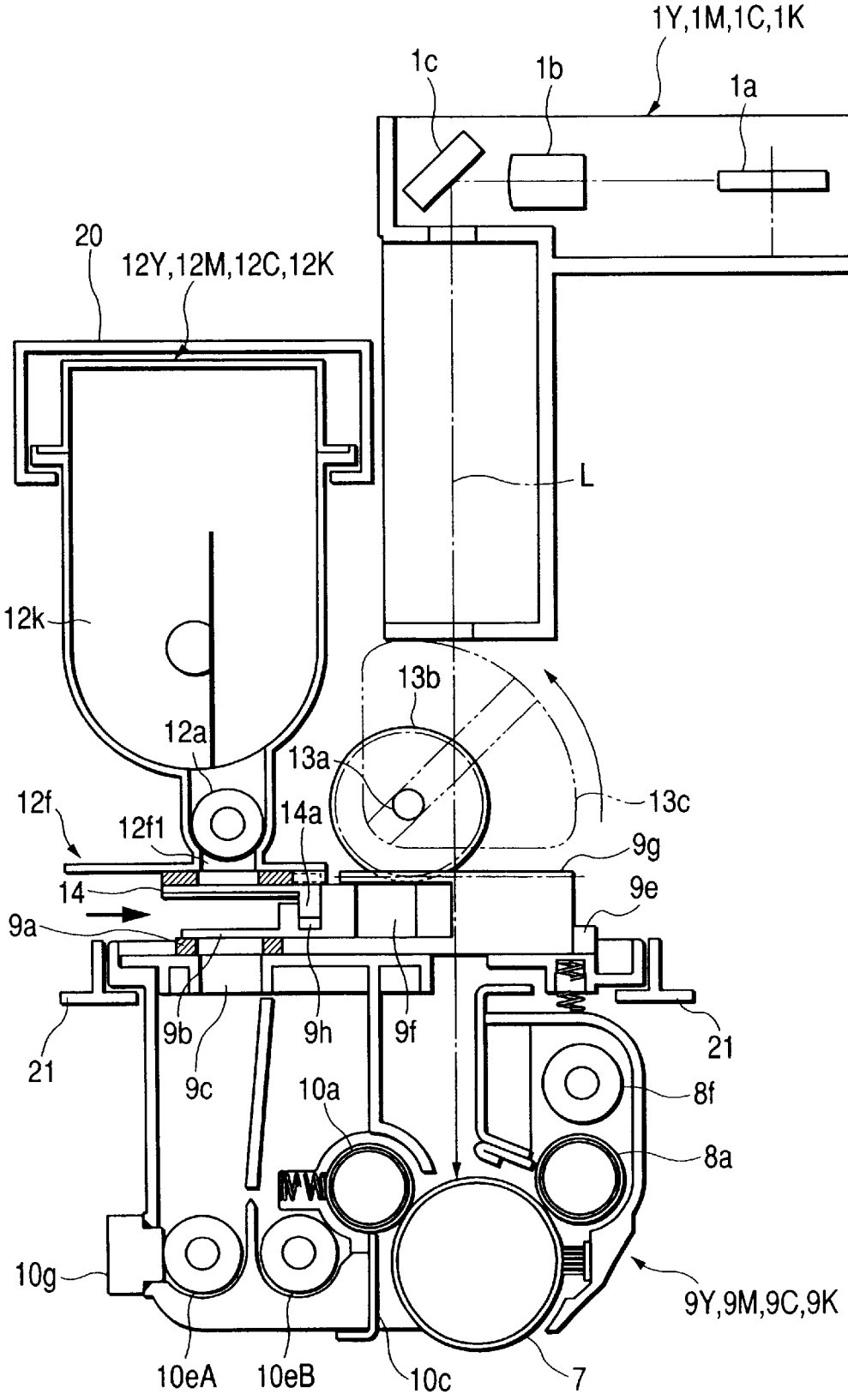
FIG. 7 is a cross-sectional view of an engagement state (sealed state) between the process cartridge and the toner replenishing container of Embodiment 1.

As shown in FIG. 7 and FIG. 23, when the toner replenishing containers 12Y, 12M, 12C, 12K are inserted into the apparatus body 100, the first driving force receiving portion 14*a* (convex) for opening and closing the toner replenishing container of the toner replenishing container opening and closing member 14 is inserted and engages with the first cartridge engagement portion (concave) 9*h* of the cartridge opening and closing member 9*b*. The engagement relationship is the same as in the case where the toner replenishing containers 12Y, 12M, 12C, 12K are first inserted into the apparatus body 100 and then the process cartridges 9Y, 9M, 9C, 9K are inserted therein.

In this engagement state, that is, the state where the process cartridges 9Y, 9M, 9C, 9K and the toner replenishing containers 12Y, 12M, 12C, 12K are inserted in the apparatus body 100, the cartridge opening and closing member 9*b* is at the second position for sealing or closing the replenishing opening portion 9*c,* and the toner replenishing container opening and closing member 14 is at the second position for sealing or closing the opening 12*f*1 of the discharge opening portion 12*f*. And in a state where the cartridge opening and closing member 9*b* is at the second position, the rack 9*g* engages with the opening and closing gear 13*b* (see FIG. 20). In this engagement state, when the rotary lever 13*c* is rotated clockwise, the cartridge opening and closing member 9*b* and the toner replenishing container opening and closing member 14 are integrally moved in the left direction (a direction perpendicular to the axial direction of the developing sleeve 10*a*) (see FIG. 6). And when the cartridge opening and closing member 9*b* and the toner replenishing container opening and closing member 14 is moved from the second position to the first position, the opening 12*f*1 of the discharge opening portion 12*f* of the toner replenishing containers 12Y, 12M, 12C, 12K and the replenishing opening portion 9*c* of the process cartridges 9Y, 9M, 9C, 9K are communicated through the opening 9*f* of the cartridge opening and closing member 9*b* so that the respective toner replenishing from the toner replenishing containers 12Y, 12M, 12C, 12K to the process cartridges 9Y, 9M, 9C, 9K is made.

On the other hand, simultaneously or a short time later when the toner replenishing container opening and closing member 14 is moved, the second cartridge engagement portion (convex) 9*j* of the cartridge opening and closing member 9*b* is inserted into and engages with the second toner replenishing container engagement portion (concave) 12*j* of the discharge opening portion 12*f* of the toner replenishing containers 12Y, 12M, 12C, 12K (see FIG. 21 and FIG. 22).

That is, by the engagement of the second cartridge engagement portion (convex) 9*j* with the second toner replenishing container engagement portion (concave) 12*j,* a position of the cartridge opening and closing member 9*b* in the height direction with respect to the discharge opening portion 12*f* of the toner replenishing containers 12Y, 12M, 12C, 12K can be correctly determined. And the sealing member 12*g* placed on the toner replenishing container 12Y, 12M, 12C, 12K side tightly adheres to the cartridge opening and closing member 9*b*. Accordingly, the toner leakage during replenishing can be preferably prevented.

[Embodiment 2]

Next, a toner replenishing structure of Embodiment 2 will be described with reference to FIG. 12, FIG. 13, FIG. 14, and FIG. 15. Note that the same components as in Embodiment 1 are denoted by the same reference numerals. Thus, components different from those in Embodiment 1 will be described.

The point in this embodiment, significantly different from Embodiment 1 is that, in contrast with Embodiment 1 where the drive transmission means such as the opening and closing gear (large) 13*b* and the opening and closing lever 13*c* for opening and closing the opening 9*f* with the cartridge opening and closing member 9*b* is placed on the apparatus body 100 side, in Embodiment 2 the drive transmission means is placed on the toner replenishing container 12Y, 12M, 12C, 12K side.

These arrangement configurations will be described in detail.

Figure 12:
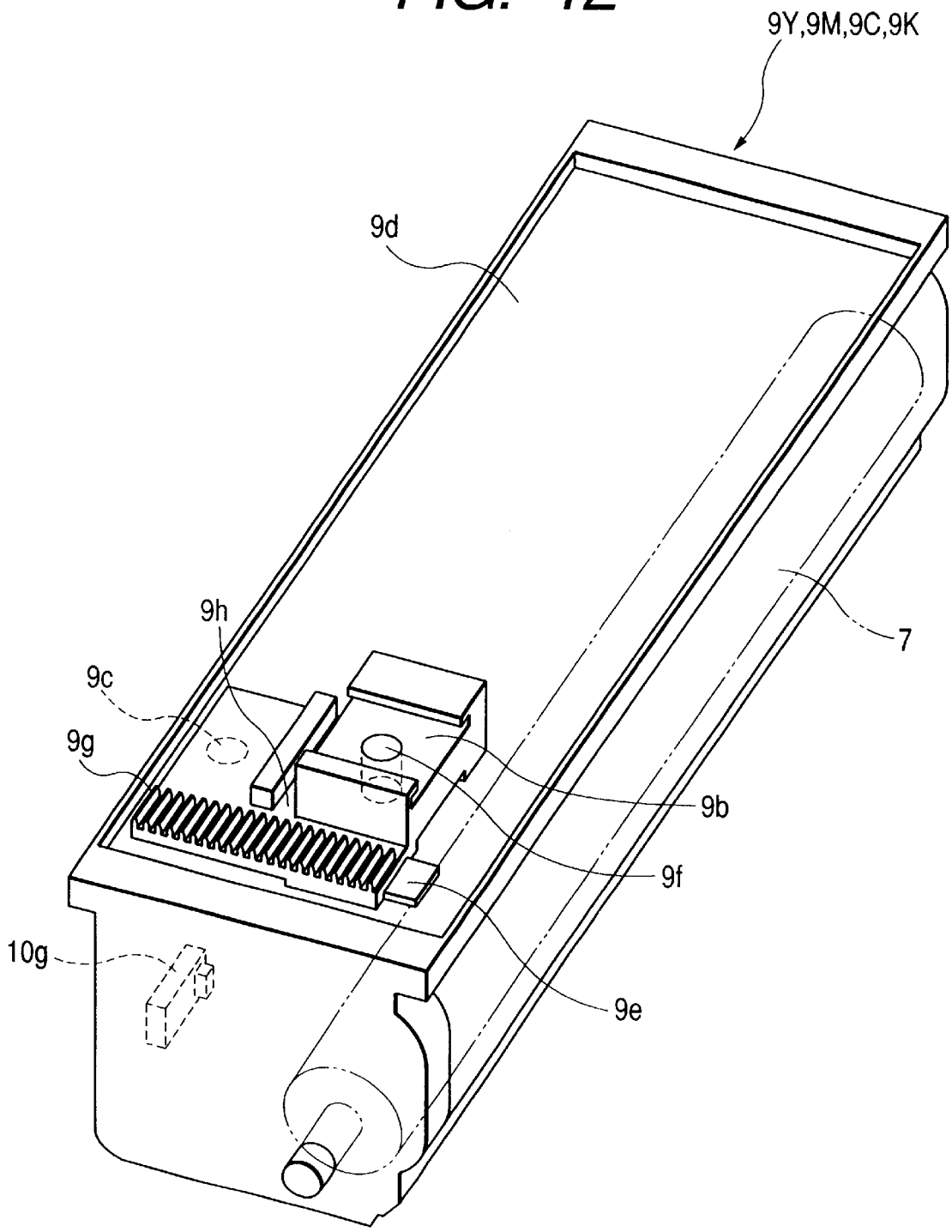
FIG. 12 is a schematic external perspective view of a process cartridge of Embodiment 2.
Figure 13:
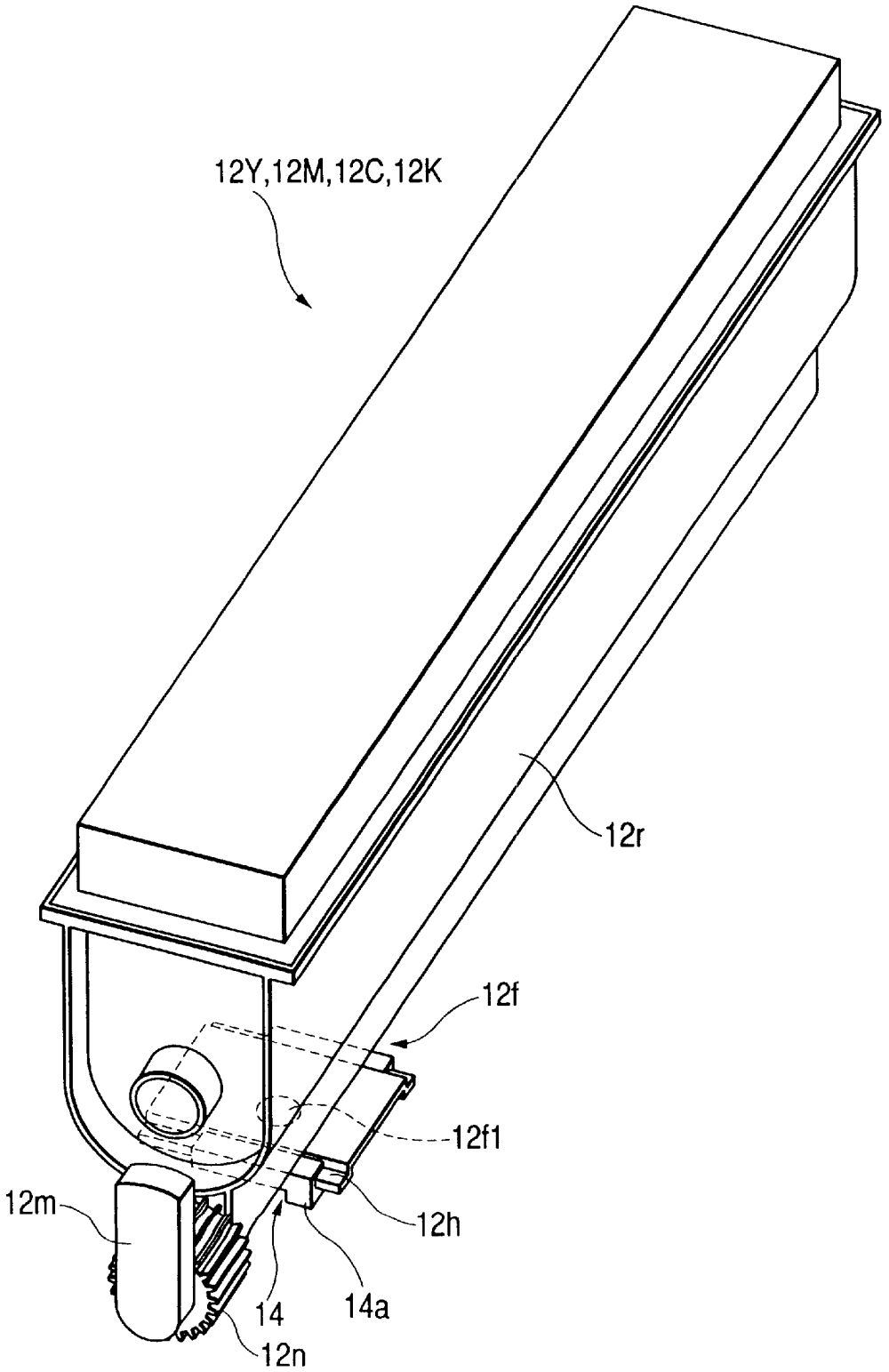
FIG. 13 is a schematic external perspective view of a toner replenishing container of Embodiment 2.

The replenishing opening portion 9*c* of the process cartridges 9Y, 9M, 9C, 9K is placed on this side in a direction of inserting the process cartridges 9Y, 9M, 9C, 9K, which is the non-driving side of the photosensitive drum 7 (see FIG. 12). On the other hand, the discharge opening portion 12*f* of the toner replenishing containers 12Y, 12M, 12C, 12K is placed on this side in a direction of inserting the process cartridges 9Y, 9M, 9C, 9K in accordance with the case of replenishing opening portion 9*c* (see FIG. 13). Further, a rotary lever 12*m* is rotatably placed on this side surface of the toner replenishing containers 12Y, 12M, 12C, 12K. And the rotary lever 12*m* is provided with a gear 12*n* as a driving member.

Here, a case where the toner replenishing containers 12Y, 12M, 12C, 12K are inserted in a state where the process cartridges 9Y, 9M, 9C, 9K have already been inserted in the apparatus body 100, will be described.

Figure 15:
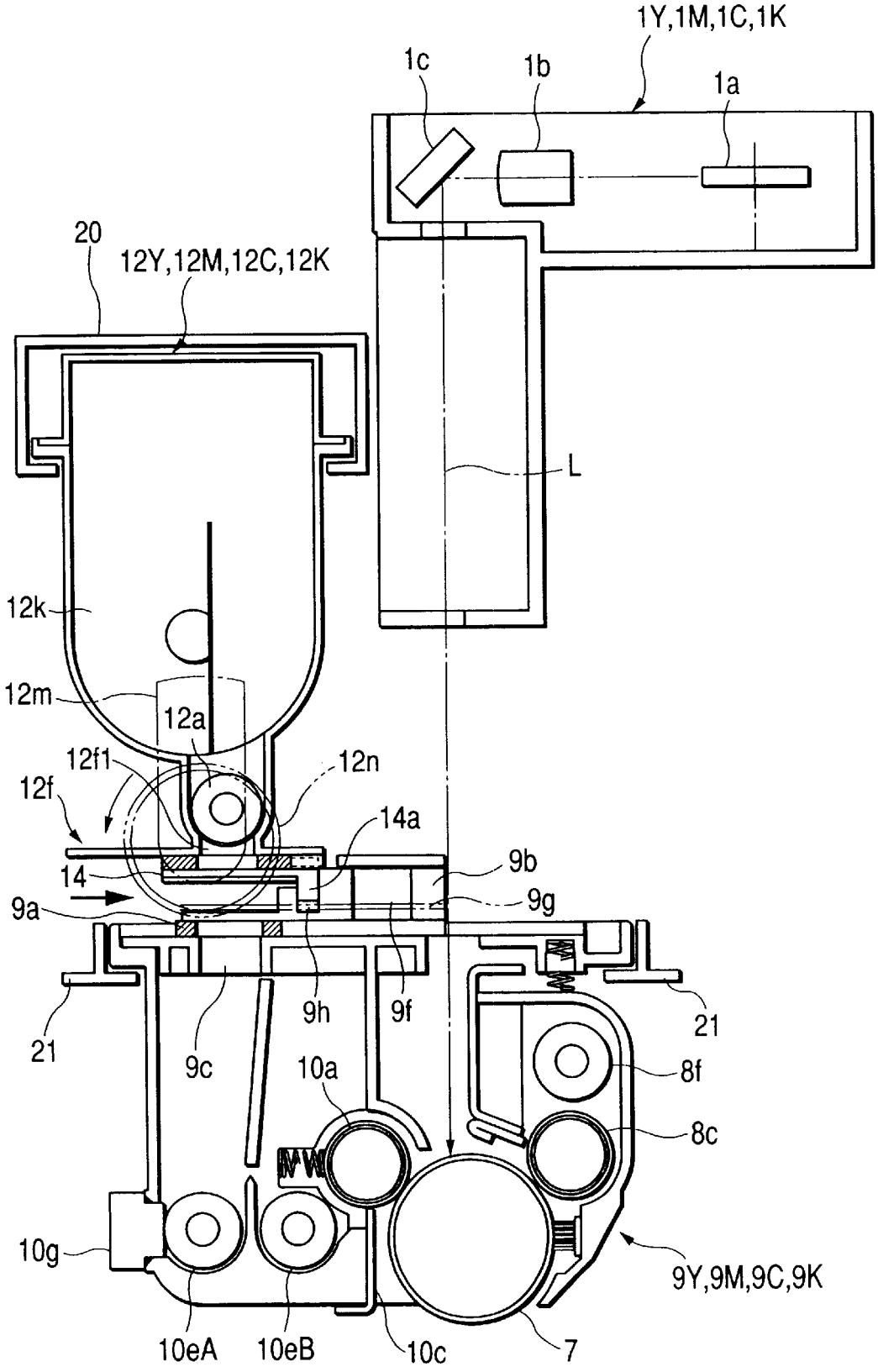
FIG. 15 is a cross-sectional view of an engagement state (sealed state) between the process cartridge and the toner replenishing container of Embodiment 2.

When the toner replenishing containers 12Y, 12M, 12C, 12K are inserted in the apparatus body 100, as shown in FIG. 15, the first driving force receiving portion 14*a* (convex) for opening and closing the toner replenishing container of the toner replenishing container opening and closing member 14 is inserted into and engages with the first cartridge engagement portion (concave) 9*h* of the cartridge opening and closing member 9*b*, that is in the second position sealing the replenishing opening portion 9*c*. This engagement relationship is the same as in the case where the toner replenishing containers 12Y, 12M, 12C, 12K are first inserted in the apparatus body 100 and then the process cartridges 9Y, 9M, 9C, 9K are inserted therein. Further at this time, the gear 12*n* provided on the rotary lever 12*m* of the toner replenishing containers 12Y, 12M, 12C, 12K is inserted into and engages with the rack 9*g* of the cartridge opening and closing member 9*b*.

In this state, when the rotary lever 12*m* is rotated clockwise, the rotation drive of the gear 12*n* is transmitted to the cartridge opening and closing member 9*b* through the rack 9*g*.

Figure 14:
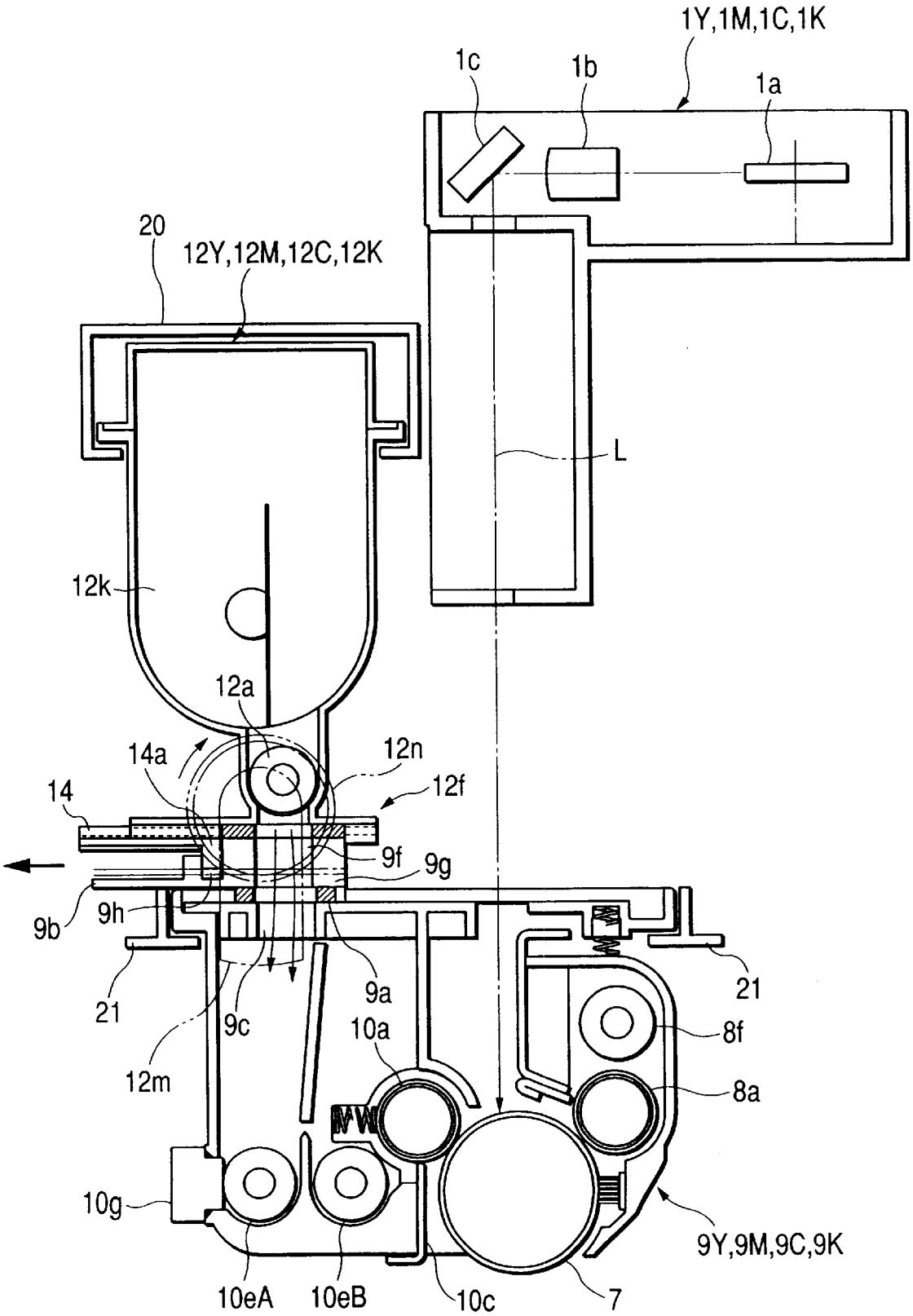
FIG. 14 is a cross-sectional view of an engagement state (opened state) between the process cartridge and the toner replenishing container of Embodiment 2.

At this time, in the same manner as described in Embodiment 1, the cartridge opening and closing member 9*b* and the toner replenishing container opening and closing member 14 are integrally moved in the left direction (see FIG. 14). And when the cartridge opening and closing member 9*b* and the toner replenishing container opening and closing member 14 is moved from the second position to the first position, as shown in FIG. 14, the opening 12*f*1 of the discharge opening portion 12*f* of the toner replenishing containers 12Y, 12M, 12C, 12K and the replenishing opening portion 9*c* of the process cartridges 9Y, 9M, 9C, 9K are communicated through the opening 9*f* of the cartridge opening and closing member 9*b* so that the toner replenishing from the toner replenishing containers 12Y, 12M, 12C, 12K to the process cartridges 9Y, 9M, 9C, 9K is made.

[Embodiment 3]

Next, a toner replenishing structure of Embodiment 3 will be described with reference to FIG. 16, FIG. 17, FIG. 18, and FIG. 24. Note that the same components as in Embodiment 1 are denoted by the same reference numerals. Thus, components different from those in Embodiment 1 will be described.

The point in this embodiment, significantly different from Embodiment 1 is that, in contrast with Embodiment 1 where the drive transmission means such as the opening and closing gear (large) 13*b* and the opening and closing lever 13*c* for opening and closing the opening 9*f* with the cartridge opening and closing member 9*b* is placed on the apparatus body 100 side, in Embodiment 3, the drive transmission means is placed on the toner replenishing container 12Y, 12M, 12C, 12K side. Further, points in this embodiment significantly different from Embodiment 2 are that, in contrast with Embodiment 2 where the replenishing opening portion 9*c* of the process cartridges 9Y, 9M, 9C, 9K and the discharge opening portion 12*f* of the toner replenishing containers 12Y, 12M, 12C, 12K are placed on this side in a direction of inserting the process cartridges 9Y, 9M, 9C and 9K, in this Embodiment, they are placed on that side in a direction of inserting the process cartridges 9Y, 9M, 9C, 9K, as in Embodiment 1.

These arrangement configurations will be described in detail.

Figure 16:
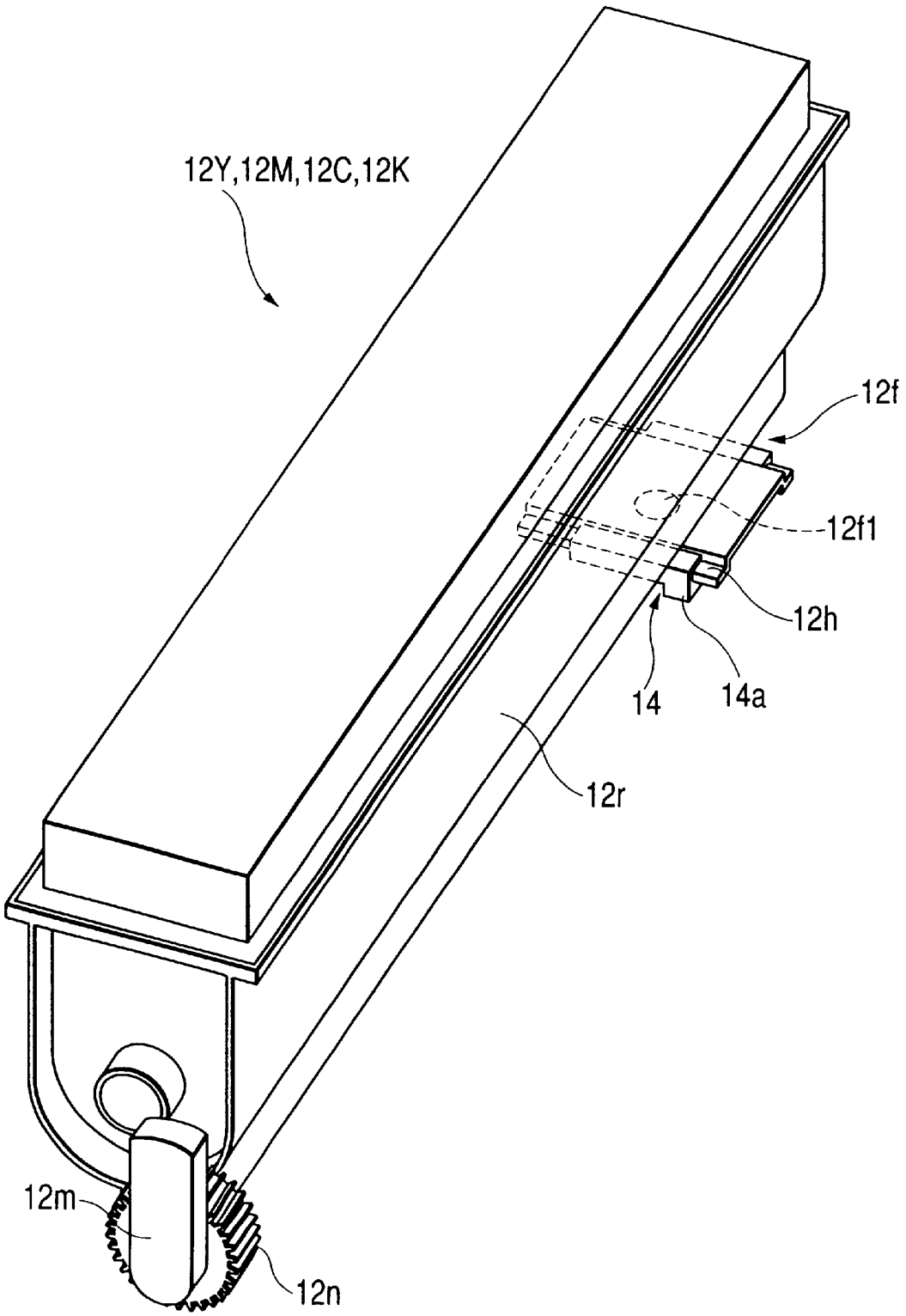
FIG. 16 is a schematic external perspective view of a toner replenishing container of Embodiment 3.
Figure 24:
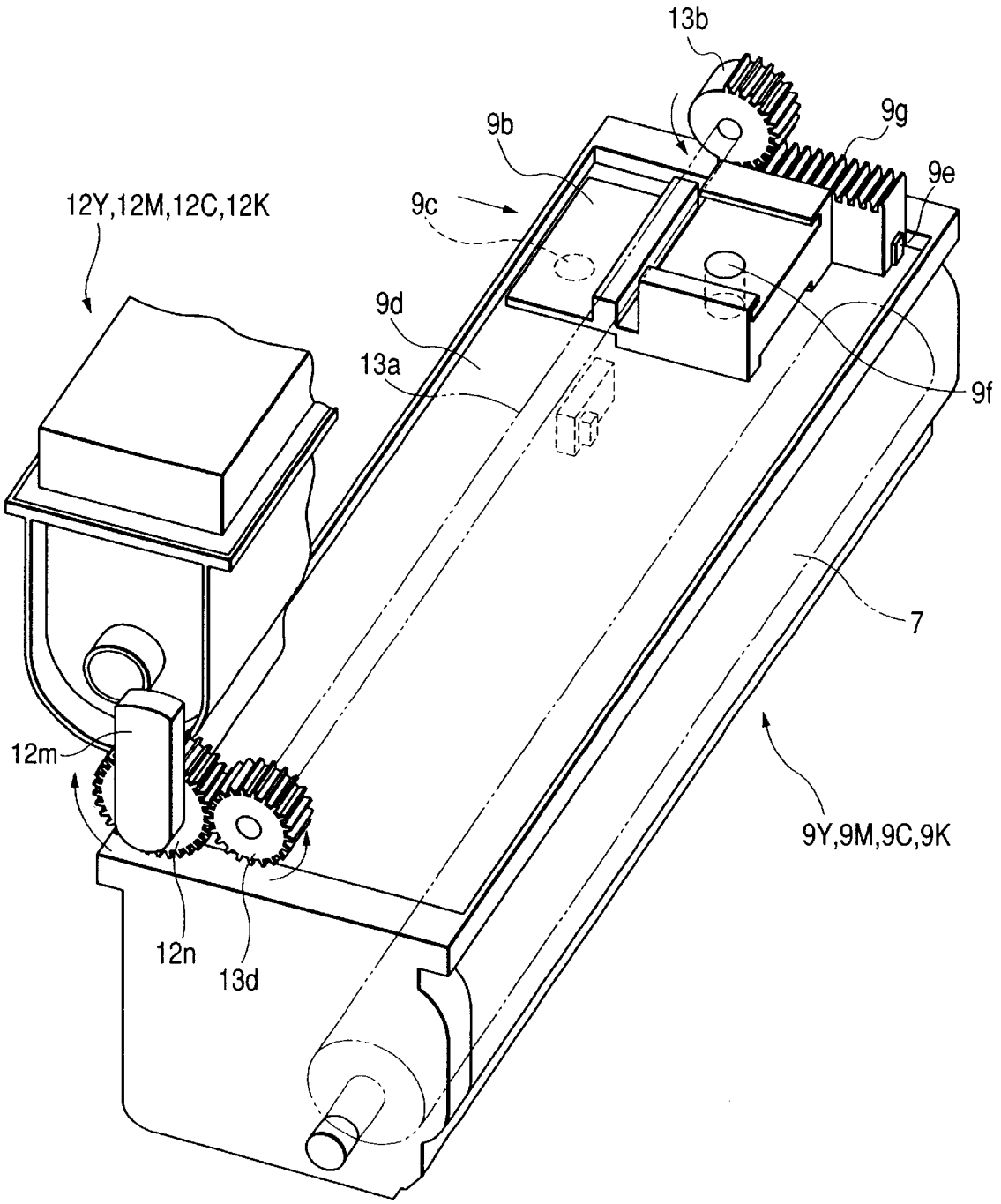
FIG. 24 is a schematic external perspective view (sealed state) of a process cartridge of Embodiment 2.

As shown in FIG. 16, the rotary lever 12*m* is rotatably placed on this side surface of the toner replenishing containers 12Y, 12M, 12C, 12K. And the rotary lever 12*m* is provided with a gear 12*n*. On the other hand, on the apparatus body 100 side, as shown in FIG. 24, the rotary shaft 13*a* is provided above the process cartridges 9Y, 9M, 9C and 9K, in parallel with the axis of the photosensitive drum 7, the opening and closing gear (large) 13*b* is fixed to the shaft end on that side, and an opening and closing gear (small) 13*d* is fixed to the shaft end on this side. And the rotary shaft 13*a* is rotatably supported with a bearing (not shown) with respect to the apparatus body 100.

Note that a case where the toner replenishing containers 12Y, 12M, 12C, 12K are inserted in a state where the process cartridges 9Y, 9M, 9C, 9K have already been inserted in the apparatus body 100, will be described.

Figure 18:
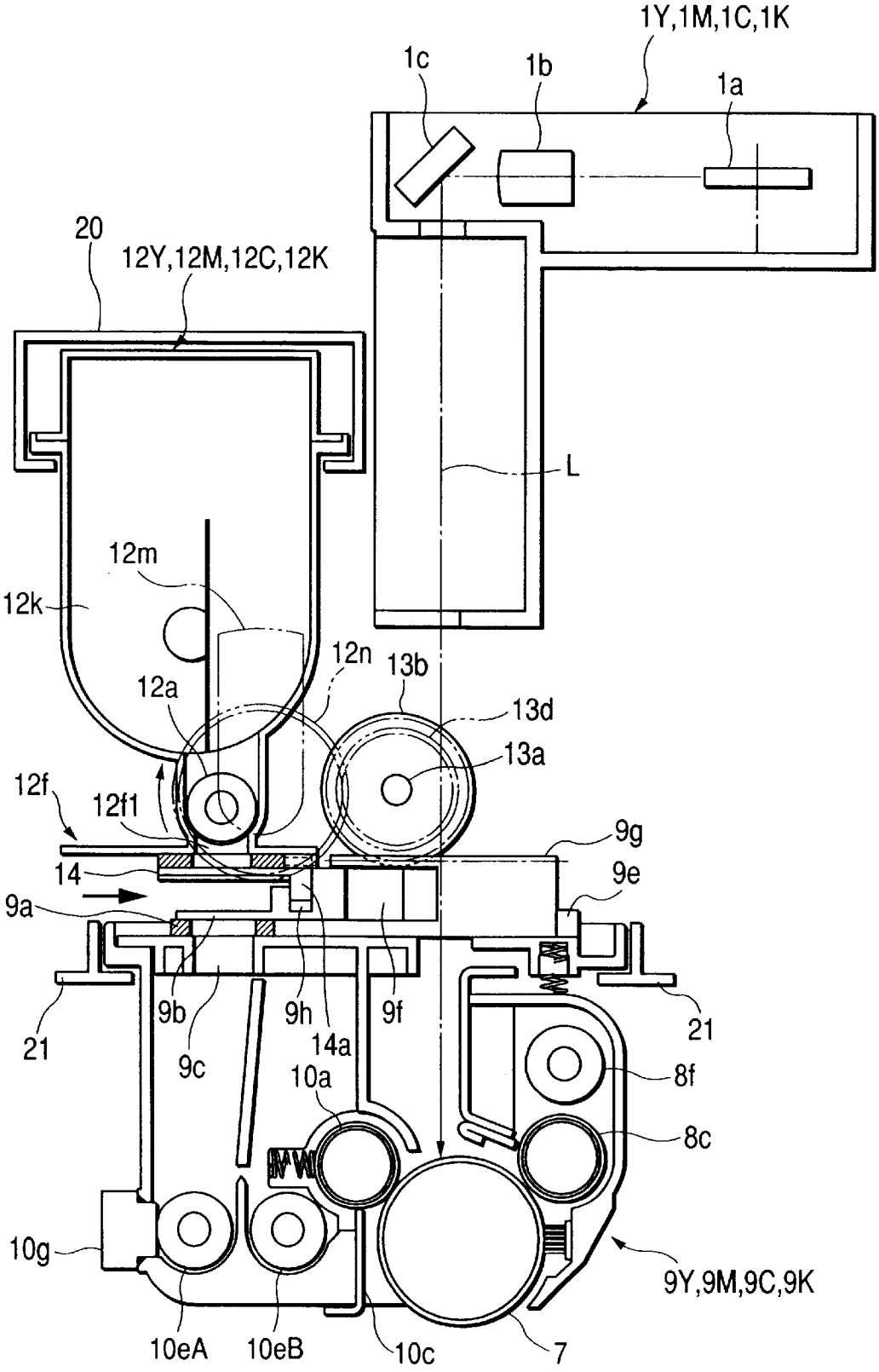
FIG. 18 is a cross-sectional view of an engagement state (sealed state) between the process cartridge and the toner replenishing container of Embodiment 3.

When the toner replenishing containers 12Y, 12M, 12C, 12K are inserted in the apparatus body 100, the first driving force receiving portion 14*a* (convex) for opening and closing the toner replenishing container of the toner replenishing container opening and closing member 14 is inserted into and engages with the first cartridge engagement portion (concave) 9*h* of the cartridge opening and closing member 9*b* that is in the second position sealing the replenishing opening portion 9*c* (see FIG. 18). This engagement relationship is the same as in the case where the toner replenishing containers 12Y, 12M, 12C, 12K arc first inserted in the apparatus body 100 and then the process cartridges 9Y, 9M, 9C, 9K are inserted therein. Further at this time, the gear 12*n* provided on the rotary lever 12*m* of the toner replenishing containers 12Y, 12M, 12C, 12K is inserted into and engages with the opening and closing gear (small) 13*c* on the apparatus body 100 side.

In this state, when the rotary lever 12*m* is rotated counterclockwise, the rotation drive of the gear 12*n* is transmitted to the cartridge opening and closing member 9*b* through the opening and closing gear (small) 13*c*, and the opening and closing gear (large) 13*b*.

Figure 17:
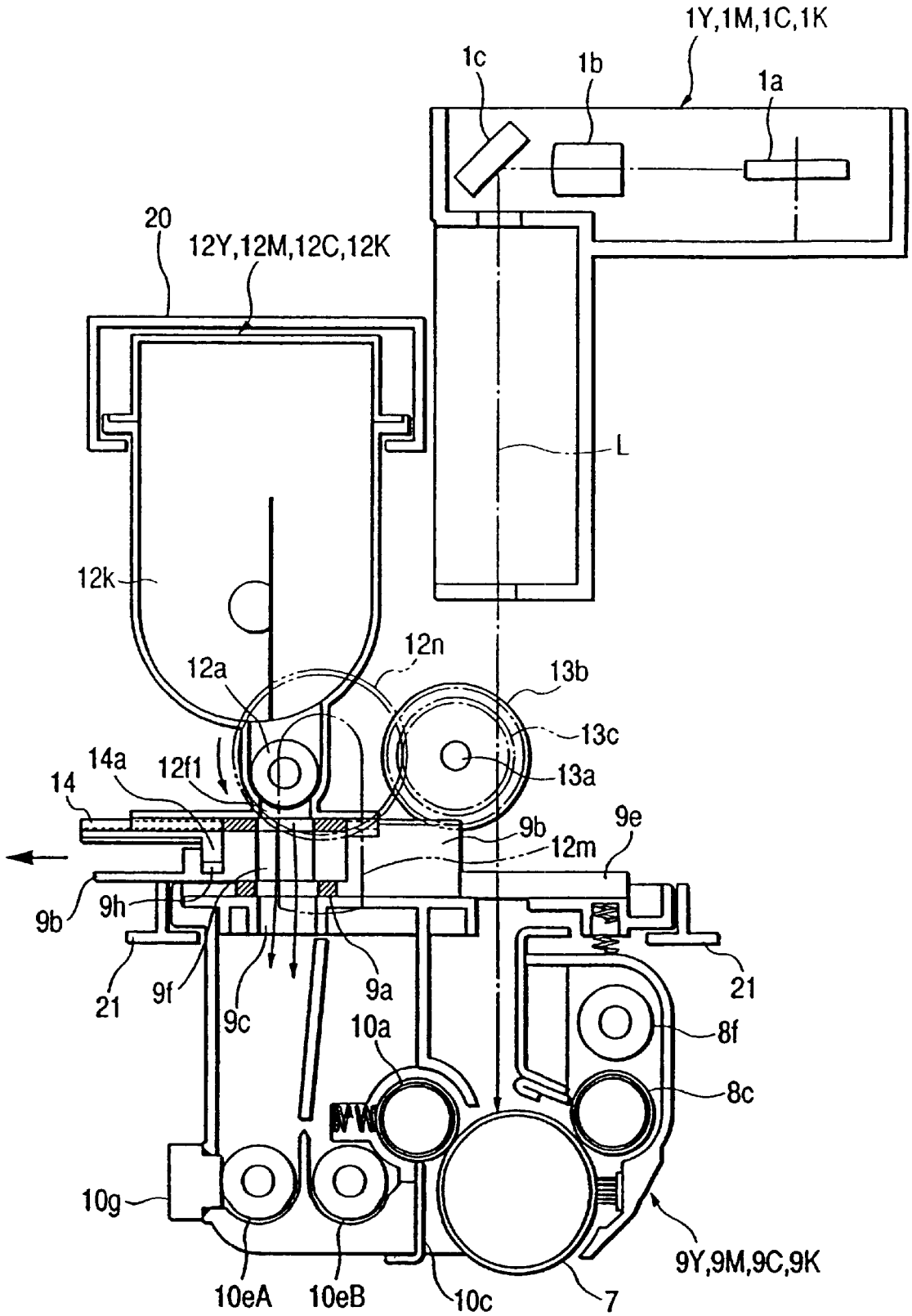
FIG. 17 is a cross-sectional view of an engagement state (opened state) between a process cartridge and the toner replenishing container of Embodiment 3.

At this time, in the same manner as described in Embodiment 1 the cartridge opening and closing member 9*b* and the toner replenishing container opening and closing member 14 are integrally moved in the left direction (see FIG. 17). And when the cartridge opening and closing member 9*b* and the toner replenishing container opening and closing member 14 are moved from the second position to the first position, as shown in FIG. 17, the opening 12*f*1 of the discharge opening portion 12*f* of the toner replenishing containers 12Y, 12M, 12C, 12K and the replenishing opening portion 9*c* of the process cartridges 9Y, 9M, 9C, 9K are communicated through the opening 9*f* of cartridge opening and closing member 9*b* so that the toner replenishing from the toner replenishing containers 12Y, 12M, 12C, 12K to the process cartridges 9Y, 9M, 9C, 9K can be made.

[Embodiment 4]

Next, a toner replenishing structure of Embodiment 4 will be described with reference to FIG. 25, FIG. 26, and FIG. 27. Note that the same components as in Embodiment 1 are denoted by the same reference numerals. Thus, components different from those in Embodiment 1 will be described.

The point in this embodiment significantly different from Embodiment 1 is that, in contrast with Embodiment 1 where the rack 9*g* is formed on the cartridge opening and closing member 9*b* and the rack 9*g* is moved by engagement with the opening and closing gear (large) 13*b* on the apparatus body 100 side, in this embodiment, opening and closing slide members 13*e* (see FIG. 26) on the apparatus body 100 side engages with the opening and closing member 9*b* and is moved by sliding of the opening and closing slide member 13*e*.

These arrangement configurations will be described in detail.

Figure 26:
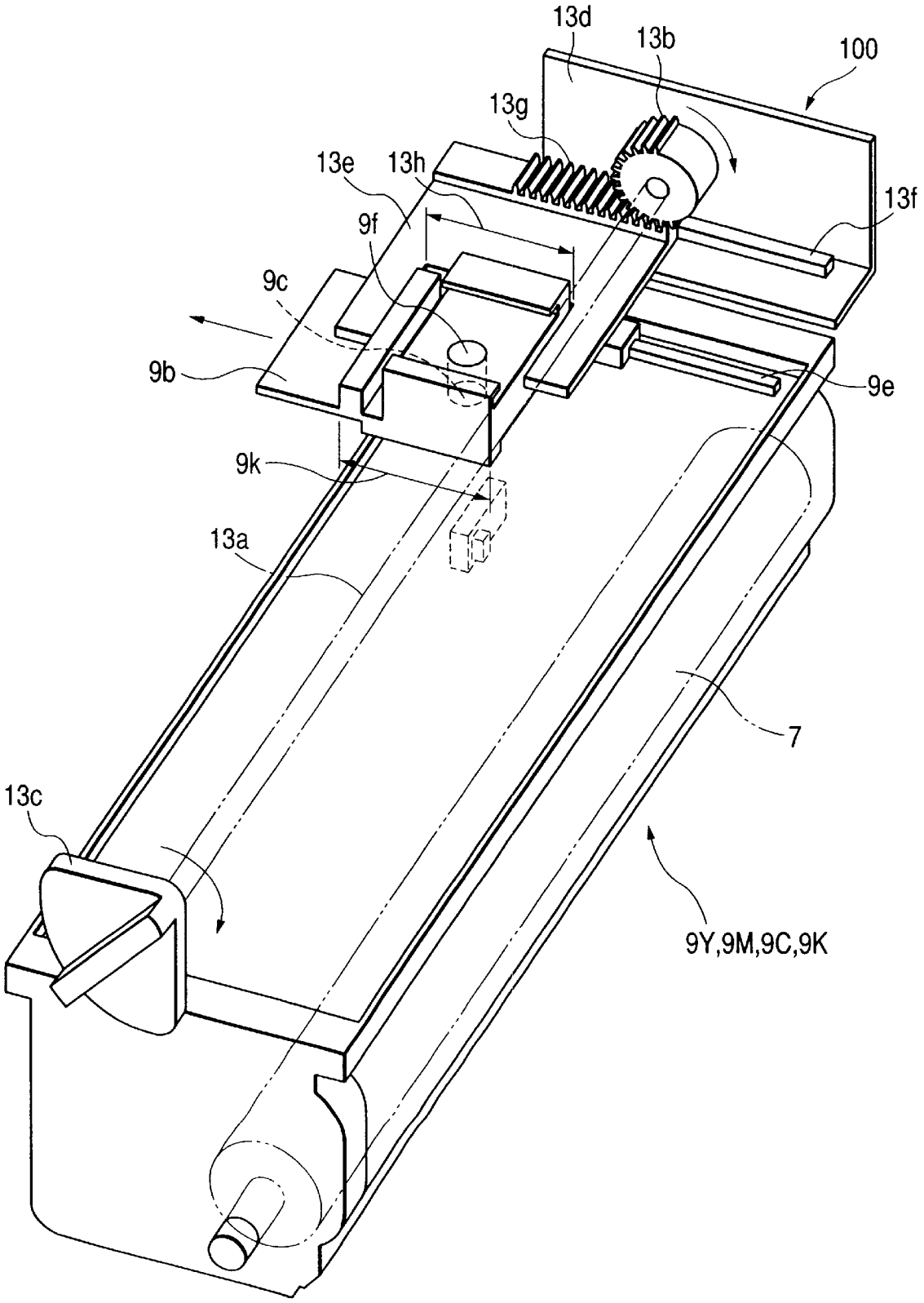
FIG. 26 is a schematic external perspective view (opened state) of the process cartridge of Embodiment 4.

As shown in FIG. 26, the rotary shaft 13*a* is provided above the process cartridges 9Y, 9M, 9C and 9K, in parallel with the axis of the photosensitive drum 7, the opening and closing gear (large) 13*b* is fixed to the shaft end on that side, and the rotary lever 13*c* is fixed to the shaft end on this side. And the rotary shaft 13*a* is rotatably supported with a bearing (not shown) with respect to the apparatus body 100.

On that side of the apparatus body 100 is placed the frame 13*d*. On the frame 13*d* are placed the opening and closing slide members 13*e* which are horizontally moved in a direction perpendicular to the axial direction of the developing sleeve 10*a* of the process cartridges 9Y, 9M, 9C and 9K. The opening and closing slide members 13*e* are moved along a guide rib 13*f* formed on the frame 13*d*.

A rack 13*g* is formed on the upper surface of the opening and closing slide member 13*e* and engages with the opening and closing gear (large) 13*b*. Further, on this side of the opening and closing slide members 13*e* is formed a concave opening and closing groove 13*h*.

Figure 25:
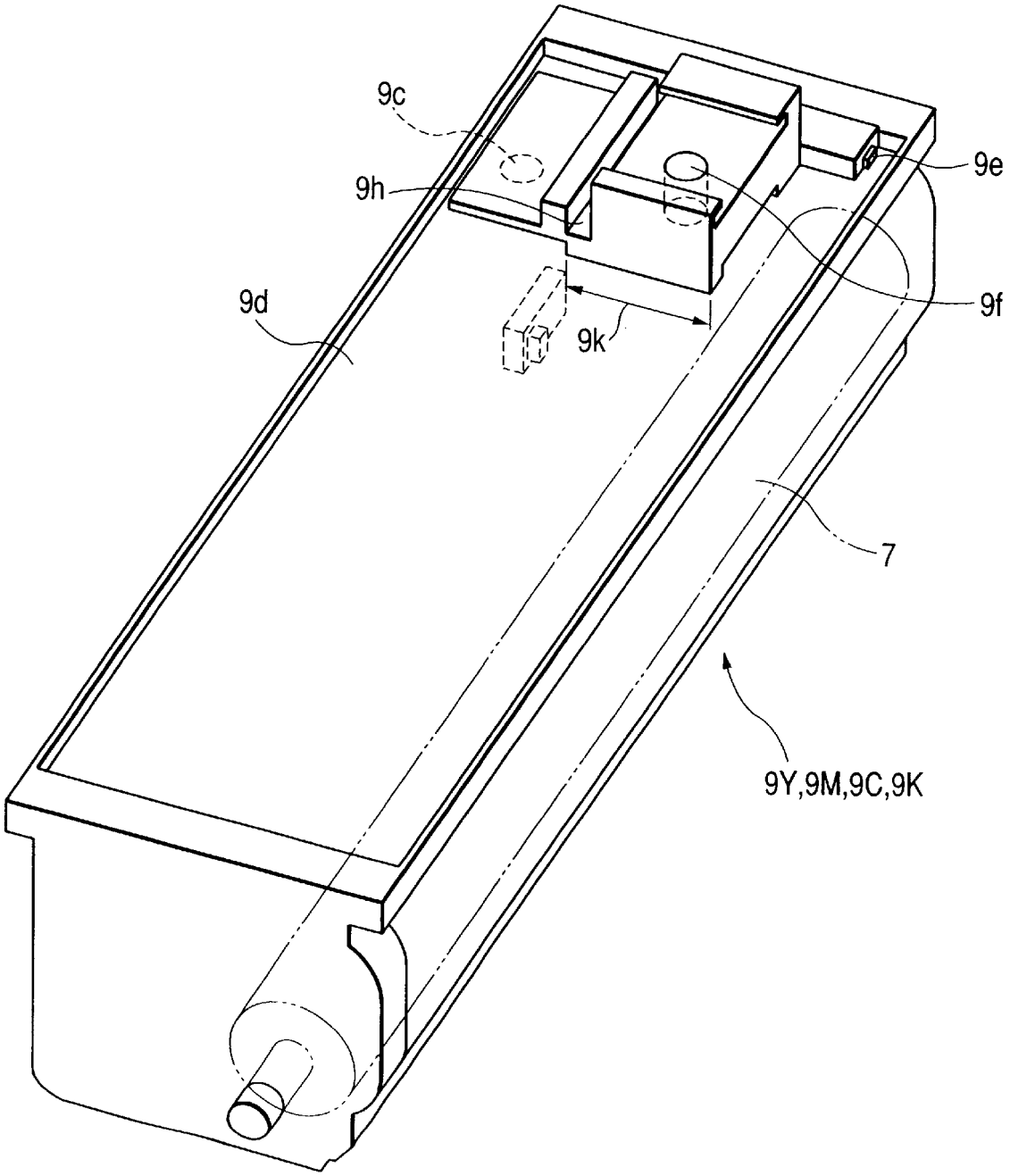
FIG. 25 is a schematic external perspective view of a process cartridge of Embodiment 4.

On the other hand, on the cartridge opening and closing member 9*b* of the process cartridges 9Y, 9M, 9C and 9K, as shown in FIG. 25 and FIG. 26, a third cartridge engagement portion (convex) 9*k* which engages with the above-mentioned opening and closing groove 13*h* is provided.

Figure 27:
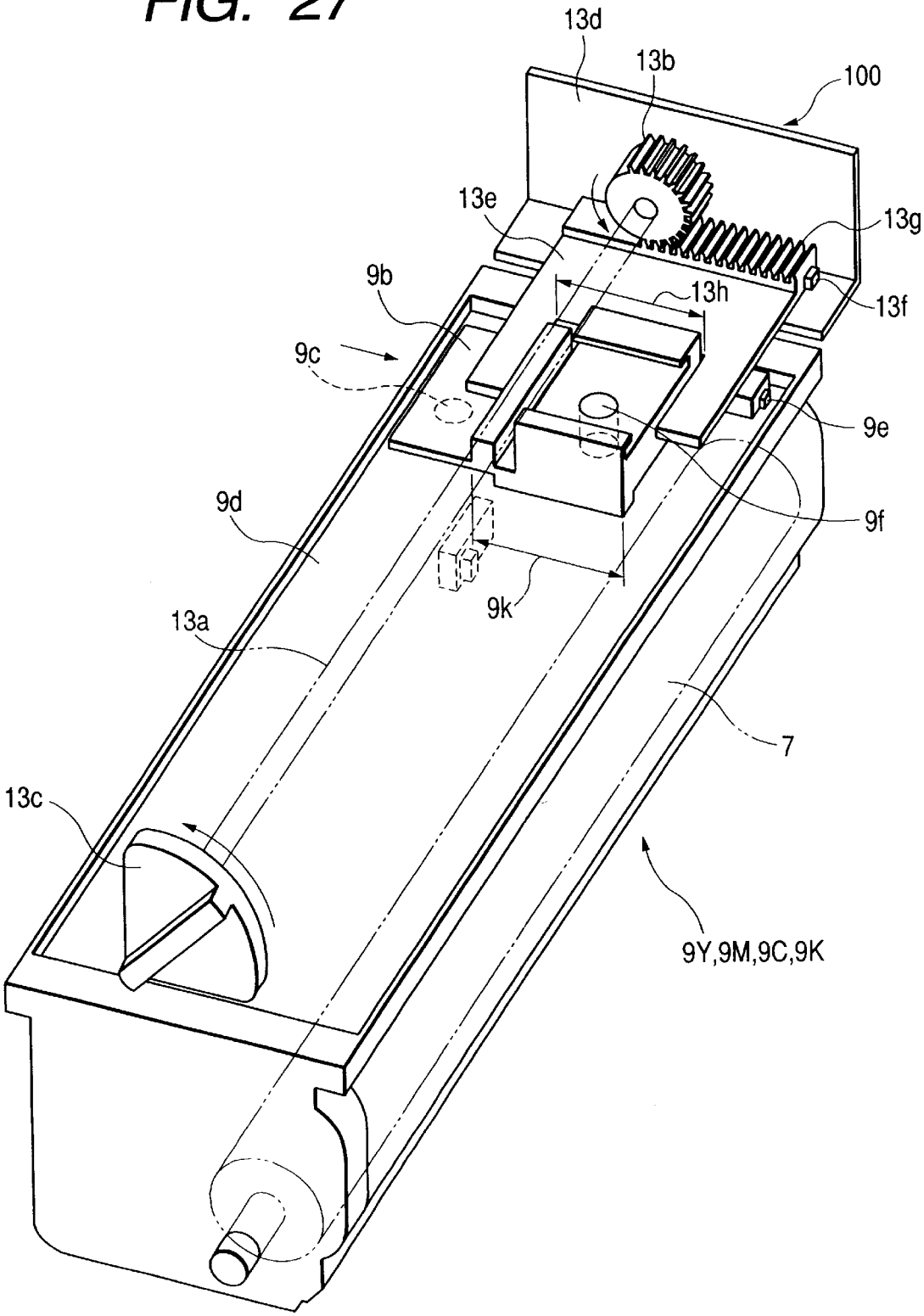
FIG. 27 is a schematic external perspective view (sealed state) of the process cartridge of Embodiment 4.

When the process cartridge 9Y, 9M, 9C, 9K are inserted into the apparatus body 100, as shown in FIG. 27, the third cartridge engagement portion (convex) 9*k* of the cartridge opening and closing member 9*b* that is at the second position where the replenishing opening portion 9*c* is sealed or closed engages with the opening and closing groove 13*h* of the opening and closing slide members 13*e* so that the third cartridge engagement portion (convex) 9*k* and then the opening and closing slide members 13*e* can be integrally moved.

When the toner replenishing containers 12Y, 12M, 12C, 12K are inserted in the apparatus body 100, as mentioned above, the first driving force receiving portion 14*a* (convex) for opening and closing the toner replenishing container of the toner replenishing container opening and closing member 14 is inserted into and engages with the cartridge engagement portion (concave) 9*h* of the cartridge opening and closing member 9*b*. This engagement relationship is the same as in the case where the toner replenishing containers 12Y, 12M, 12C, 12K are first inserted in the apparatus body 100 and then the process cartridges 9Y, 9M, 9C, 9K are inserted therein.

Then, when the rotary lever 13*c* is rotated clockwise, the opening and closing gear (large) 13*b* is rotated through the rotary shaft 13*a*, the opening and closing slide members 13*e* are moved in a direction perpendicular to the axial direction of the developing sleeve 10*a*, and at the same time the cartridge opening and closing member 9*b* and the toner replenishing container opening and closing member 14 are moved in the same direction (see FIG. 26). And when the cartridge opening and closing member 9*b* and the toner replenishing container opening and closing member 14 are moved from the second position to the first position, the opening 12*f*1 of the discharge opening portion 12*f* of the toner replenishing containers 12Y, 12M, 12C, 12K and the replenishing opening portion 9*c* of the process cartridges 9Y, 9M, 9C, 9K are communicated through the opening 9*f* of cartridge opening and closing member 9*b* so that the toner replenishing from the toner replenishing containers 12Y, 12M, 12C, 12K to the process cartridges 9Y, 9M, 9C, 9K can be made.

[Embodiment 5]

Next, a toner replenishing structure of Embodiment 5 will be described with reference with FIG. 28 and FIG. 29. Note that the same components as in Embodiment 4 are denoted by the same reference numerals. Thus, components different from those in Embodiment 4 will be described.

The point in this embodiment significantly different from Embodiment 1 is that, in contrast with Embodiment 4 where the opening and closing slide members 13*e* are independently arranged at four positions in each cartridge of four colors, Embodiment 5 has one opening and closing slide member (see FIG. 29), and by interlocking with the movement of the opening and closing slide members 13*e*, the cartridge opening and closing members 9*b* at four positions can be simultaneously opened or closed.

Figure 29:
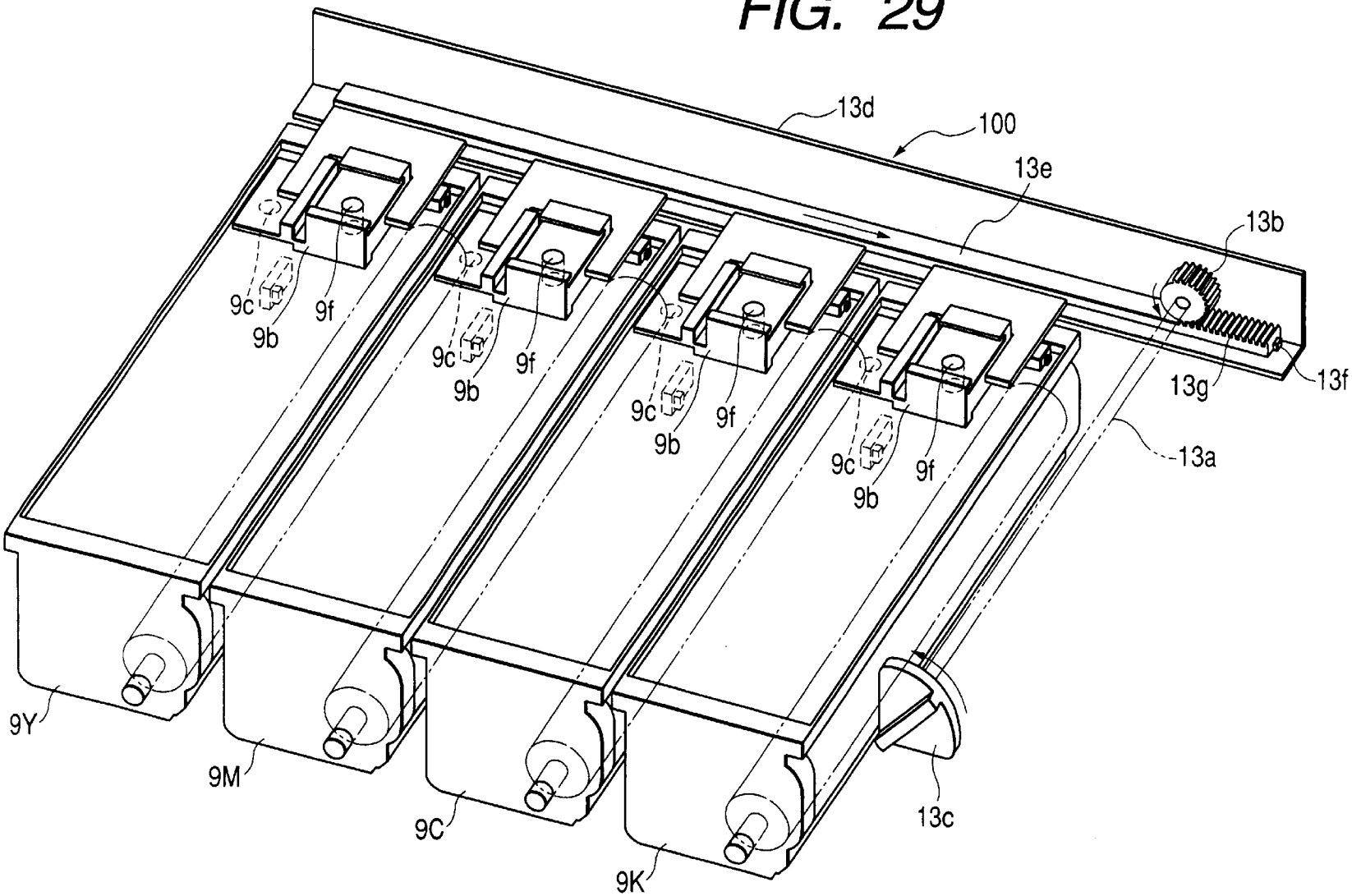
FIG. 29 is a schematic external perspective view (sealed state) of the process cartridge of Embodiment 5.

That is, when the process cartridge 9Y, 9M, 9C, 9K are inserted into the apparatus body 100, as shown in FIG. 29, the third cartridge engagement portion (convex) 9*k* of each cartridge opening and closing member 9*b* that is at the second position where the replenishing opening portion 9*c* of the process cartridge 9Y, 9M, 9C, 9K is sealed engages with the opening and closing groove 13*h* of the opening and closing slide member 13*e* so that the third cartridge engagement portion (convex) 9*k* and then the opening and closing slide members 13*e* can be integrally moved.

And when the toner replenishing containers 12Y, 12M, 12C, 12K are inserted in the apparatus body 100, as mentioned above, the first driving force receiving portion 14*a* (convex) for opening and closing the toner replenishing container of the toner replenishing container opening and closing member 14 is inserted into and engages with the first cartridge engagement portion (concave) 9*h* of each of the cartridge opening and closing members 9*b*. This engagement relationship is the same as in the case where the toner replenishing containers 12Y, 12M, 12C, 12K are first inserted in the apparatus body 100 and then the process cartridges 9Y, 9M, 9C, 9K are inserted therein.

Figure 28:
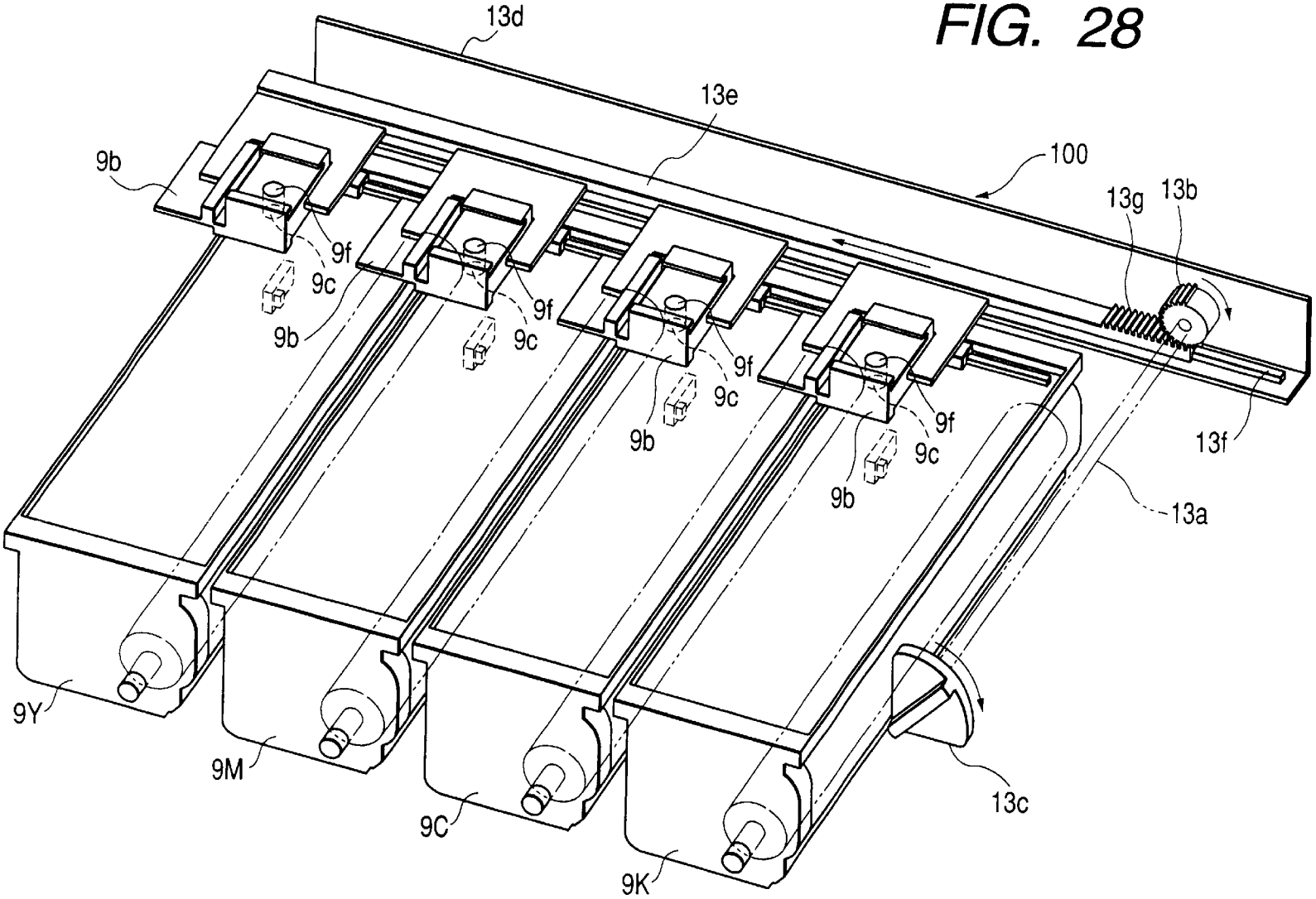
FIG. 28 is a schematic external perspective view (opened state) of a process cartridge of Embodiment 5.

Then, when the rotary lever 13*c* is rotated clockwise, the opening and closing gear (large) 13*b* is rotated through the rotary shaft 13*a*, the opening and closing slide member 13*e* is moved in a direction perpendicular to the axial direction of the developing sleeve 10*a*, and at the same time all cartridge opening and closing members 9*b* and the toner replenishing container opening and closing member 14 are moved in the same direction (see FIG. 28). And when all the cartridge opening and closing members 9*b* and the toner replenishing container opening and closing member 14 are moved from the second position to the first position, the opening 12*f*1 of the discharge opening portion 12*f* of the toner replenishing containers 12Y, 12M, 12C, 12K and the replenishing opening portion 9*c* of the process cartridges 9Y, 9M, 9C, 9K are communicated through the opening 9*f* of each of the cartridge opening and closing members 9*b* so that the toner replenishing from the toner replenishing containers 12Y, 12M, 12C, 12K to the process cartridges 9Y, 9M, 9C, 9K can be made.

[Other Embodiments]

The toner replenishing containers shown Embodiments 1 to 5 are not limited to the application to or a developing cartridge using the two-component development, but may also be used in a process cartridge using monocomponent development. Further, powder contained in a toner replenishing container may include not only toner but also a mixture of toner and magnetic carrier, a so called developer.

Further, although a color toner electrophotographic image forming apparatus that uses two-component developer is described as an example in the above Embodiments, the present invention can be preferably applied to a color toner electrophotographic image forming apparatus using a monocomponent developer and a monochromatic electrophotographic image forming apparatus and the same effects can be also obtained.

Further, an electrophotographic photosensitive member includes not only the photosensitive drum but also, for example, the following members. First, as the photosensitive member, a photoconductor is used. The photoconductor includes, for example, amorphous silicon, amorphous selenium, zinc oxide, titanium oxide, organic photoconductor (OPC) and the like. Further, as a shape on which the photosensitive member is mounted, for example, a drum shape or a belt shape are used. In a drum-type photosensitive member, a photoconductor vapor-deposited or coated cylinder of 5 aluminum alloy or the like can be used.

Incidentally the above-described process cartridge is defined as a member including, for example, electrophotographic photosensitive member (image bearing member) and at least one of process means. Therefore, the configuration of the process cartridge includes, other than the ones in the Embodiments above, a cartridge integrally composed of an electrophotographic photosensitive member, developing means and charging means which is detachably attachable to the apparatus body, a cartridge integrally composed of an electrophotographic photosensitive member and developing means which is detachably attachable to the apparatus body, a cartridge integrally composed of an electrophotographic photosensitive member and cleaning means which is detachably attachable to the apparatus body, and further, a cartridge integrally combined with two or more of the process means which is detachably attachable to the apparatus body.

That is, the above-described process cartridge is a cartridge integrally composed of at least one of the charging means, developing means or cleaning means and an electrophotographic photosensitive member which is detachably attachable to the image forming apparatus body. And a user himself can attach and detach this process cartridge to the apparatus body. Accordingly a user can perform maintenance by himself.

Further, in the above-described Embodiments, as an electrophotographic image forming apparatus a color laser beam printer is shown. However, the present invention is not limited to this. Thus the present invention can be applied to another electrophotographic image forming apparatus such as an electrophotographic copier, a facsimile device or a word processor.

Also, in the above-mentioned embodiments, a developing cartridge, which does not have an image bearing member but is provided with a developer containing portion and developer bearing member can be adopted in place of the process cartridge.

What is claimed is:

1. A developer replenishing container detachably attachable to a main body of an image forming apparatus, comprising:

a developer containing portion for containing a developer;

a replenishing opening portion for discharging the developer contained in said developer containing portion to a cartridge including a developing device detachably mountable to said main body of said image forming apparatus;

a shutter member movable between an opened position and a closed position for opening and closing said replenishing opening portion; and a force receiving portion for receiving a force from said cartridge for moving said shutter member from the closed position to the opened position.

2. A developer replenishing container according to claim 1, wherein said developer replenishing container has a positioning portion for positioning said developer replenishing container in said main body of said image forming apparatus.

3. A developer replenishing container according to claim 1, wherein said cartridge includes an engagement portion which engages with said force receiving portion, and said shutter member can be moved from the closed position to the opened position by movement of said engagement portion.

4. A developer replenishing container according to claim 3, wherein said shutter member includes said force receiving portion.

5. A developer replenishing container according to claim 3, wherein said shutter member can be moved from the opened position to the closed position by movement of said engagement portion.

6. A developer replenishing container according to claim 1, wherein said developer replenishing container and said cartridge are independently detachably attachable to said main body of said image forming apparatus.

7. A developer replenishing container according to claim 1 or 3, wherein said developer containing portion includes an engagement portion which engages with said cartridge.

8. A developer replenishing container according to claim 1, wherein said developer replenishing container has a rotary member for carrying a developer, and said shutter member is provided near a drive transmission portion side for transmitting drive to said rotary member in the longitudinal direction of said developer replenishing container.

9. A developer replenishing container according to claim 1, wherein said developer replenishing container has a rotary member for carrying a developer, and said shutter member can be moved in a direction crossing an axial direction of rotation of said rotary member.

10. A developer replenishing container according to claim 1, wherein said developer replenishing container has a driving member for imparting the force to said cartridge.

11. A developer replenishing container according to claim 1, wherein said cartridge has a receiving opening portion for receiving a developer from said replenishing opening portion, and a shutter member movable between an opened position and a closed position for opening and closing said receiving opening portion, said force receiving portion receiving the force from said shutter member of said cartridge.

12. A cartridge detachably mountable in a main body of an image forming apparatus, comprising:

a developer bearing member for bearing a developer for developing an electrostatic image formed on an image bearing member;

a developer containing portion for containing the developer;

a receiving opening portion for receiving the developer from a replenishing opening portion provided in a developer replenishing container detachably mountable to said main body of said image forming apparatus; and a force transmitting portion for transmitting a force, to said developer replenishing container, for moving a shutter member that is provided in said developer replenishing container from a closed position to an opened position.

13. A cartridge according to claim 12, wherein said cartridge has a positioning portion for positioning said cartridge in said main body of said image forming apparatus.

14. A cartridge according to claim 12, wherein said force transmitting portion includes an engagement portion which engages with said shutter member, and said shutter member can be moved from the closed position to the opened position by movement of said engagement portion.

15. A cartridge according to claim 14, wherein said shutter member can be moved from the opened position to the closed position by movement of said engagement portion.

16. A cartridge according to claim 12, wherein said cartridge has a cartridge shutter member which enables said receiving opening portion to open and close.

17. A cartridge according to claim 16, wherein said cartridge shutter member has said force transmitting portion, said force transmitting portion including an engagement portion which engages with said shutter member, and said shutter member can be moved from the closed position to the opened position by moving said cartridge shutter member so as to open said receiving opening portion.

18. A cartridge according to claim 12, wherein said developer replenishing container and said cartridge are independently detachably attachable to said main body of said image forming apparatus.

19. A cartridge according to claim 12, wherein said shutter member is provided near a drive transmission portion for transmitting drive to said developer bearing member in a longitudinal direction of said cartridge.

20. A cartridge according to claim 12, wherein said shutter member is movable in a direction crossing an axial direction of rotation of said developer bearing member.

21. A cartridge according to claim 12, wherein said cartridge has an engagement portion which engages with a container body of said developer replenishing container.

22. A cartridge according to claim 12, wherein said cartridge has an image bearing member for bearing an image.

23. An image forming apparatus comprising:

a cartridge detachably mountable to a main body of said image forming apparatus; and a developer replenishing container for containing a developer and detachably mountable to said main body of said image forming apparatus, said developer replenishing container including a shutter member for opening and closing a replenishing opening of said container;

wherein said shutter member is movable between an opened position and a closed position by receiving a force from a cartridge side when said container and said cartridge are attached to said main body of said image forming apparatus.

* * * * *